US008590609B2

(12) United States Patent
Smithson et al.

(10) Patent No.: US 8,590,609 B2
(45) Date of Patent: Nov. 26, 2013

(54) SNEAK PATH ELIMINATOR FOR DIODE MULTIPLEXED CONTROL OF DOWNHOLE WELL TOOLS

(75) Inventors: Mitchell C. Smithson, Pasadena, TX (US); Joel D. Shaw, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 470 days.

(21) Appl. No.: 13/040,180

(22) Filed: Mar. 3, 2011

(65) Prior Publication Data

US 2011/0210609 A1 Sep. 1, 2011

Related U.S. Application Data

(63) Continuation-in-part of application No. 12/792,298, filed on Jun. 2, 2010, which is a continuation-in-part of application No. PCT/US2008/075668, filed on Sep. 9, 2008.

(51) Int. Cl.
*E21B 23/00* (2006.01)

(52) U.S. Cl.
USPC ..... 166/65.1; 166/381; 166/373; 166/316

(58) Field of Classification Search
USPC ..... 166/381, 373, 65.1, 316
See application file for complete search history.

(56) References Cited

U.S. PATENT DOCUMENTS

| | | | | |
|---|---|---|---|---|
| 3,327,791 | A | 6/1967 | Harrigan, Jr. | |
| 3,368,196 | A * | 2/1968 | Mazzagatti et al. | 367/27 |
| 3,427,580 | A | 2/1969 | Brock | |
| 3,430,712 | A | 3/1969 | Stafford | |
| 3,565,189 | A | 2/1971 | Hart | |
| 3,575,650 | A | 4/1971 | Fengler | |
| 3,717,095 | A | 2/1973 | Vann | |
| 3,906,328 | A | 9/1975 | Wenrich | |
| 4,010,412 | A | 3/1977 | Forman | |
| 4,138,669 | A | 2/1979 | Edison et al. | |
| 4,279,304 | A | 7/1981 | Harper | |

(Continued)

FOREIGN PATENT DOCUMENTS

| | | | |
|---|---|---|---|
| WO | 2004012040 | A2 | 2/2004 |
| WO | WO2004001240 | A2 | 2/2004 |

(Continued)

OTHER PUBLICATIONS

Written Opinion for PCT International Application No. PCT/US2012/025556 dated Feb. 15, 2013.

(Continued)

*Primary Examiner* — Jennifer H Gay
*Assistant Examiner* — Elizabeth Gitlin
(74) *Attorney, Agent, or Firm* — Booth Albanesi Schroeder, LLC

(57) ABSTRACT

A system for selectively actuating multiple load devices, such as well tools, which are selectively actuated by applying a predetermined voltage across a predetermined pair of conductors. At least one lockout device is associated with each load device. The lockout device prevents current from flowing through the respective load device until voltage across the pair of the conductors exceeds a predetermined minimum. A method is provided for selecting well tools for actuation by applying a minimum voltage across a set of conductors and a lockout device. Leak paths are prevented from draining off current by the lockout devices. A system is provided for applying current to bidirectional load devices such as downhole pumps and motors.

10 Claims, 15 Drawing Sheets

(56) References Cited

U.S. PATENT DOCUMENTS

| | | | | |
|---|---|---|---|---|
| 4,303,128 | A | | 12/1981 | Marr, Jr. |
| 4,345,650 | A | | 8/1982 | Wesley |
| 4,364,587 | A | | 12/1982 | Samford |
| 4,396,062 | A | | 8/1983 | Iskander |
| 4,442,903 | A | | 4/1984 | Schutt et al. |
| 4,467,833 | A | | 8/1984 | Satterwhite |
| 4,485,780 | A | | 12/1984 | Price et al. |
| 4,495,990 | A | | 1/1985 | Titus et al. |
| 4,526,667 | A | | 7/1985 | Parkhurst et al. |
| 4,527,636 | A | | 7/1985 | Bordon |
| 4,570,715 | A | | 2/1986 | Van Meurs et al. |
| 4,618,197 | A | | 10/1986 | White |
| 4,716,960 | A | | 1/1988 | Estlund |
| 4,747,451 | A | | 5/1988 | Adams, Jr. et al. |
| 4,765,184 | A | | 8/1988 | Delatorre |
| 4,911,239 | A | | 3/1990 | Winckler et al. |
| 4,919,201 | A | | 4/1990 | Bridges et al. |
| 4,921,438 | A | | 5/1990 | Godfrey et al. |
| 4,945,995 | A | | 8/1990 | Tholance et al. |
| 4,967,048 | A | | 10/1990 | Langston |
| 4,984,594 | A | | 1/1991 | Venegar et al. |
| RE33,690 | E | | 9/1991 | Adams, Jr. et al. |
| 5,058,683 | A | | 10/1991 | Godfrey et al. |
| 5,099,918 | A | | 3/1992 | Bridges et al. |
| 5,113,379 | A | * | 5/1992 | Scherbatskoy ..... 367/83 |
| 5,156,220 | A | | 10/1992 | Forehand |
| 5,166,677 | A | | 11/1992 | Schoenberg |
| 5,172,717 | A | | 12/1992 | Boyle |
| 5,207,273 | A | | 5/1993 | Cates et al. |
| 5,251,703 | A | | 10/1993 | Skinner |
| 5,279,363 | A | | 1/1994 | Schultz et al. |
| 5,282,508 | A | | 2/1994 | Ellingsen et al. |
| 5,332,035 | A | | 7/1994 | Schultz et al. |
| 5,343,963 | A | | 9/1994 | Bouldin et al. |
| 5,375,658 | A | | 12/1994 | Schultz et al. |
| 5,469,000 | A | | 11/1995 | Geysen |
| 5,516,603 | A | | 5/1996 | Holcombe |
| 5,547,029 | A | | 8/1996 | Rubbo et al. |
| 5,839,508 | A | | 11/1998 | Tubel et al. |
| 5,868,201 | A | | 2/1999 | Bussear et al. |
| 5,889,374 | A | | 3/1999 | Pezzani |
| 5,896,076 | A | | 4/1999 | Van Namen |
| 5,908,365 | A | | 6/1999 | LaJaunie |
| 6,015,011 | A | | 1/2000 | Hunter |
| 6,032,733 | A | | 3/2000 | Ludwig et al. |
| 6,164,375 | A | | 12/2000 | Carisella |
| 6,176,308 | B1 | | 1/2001 | Pearson |
| 6,179,052 | B1 | | 1/2001 | Purkis |
| 6,247,536 | B1 | | 6/2001 | Leismer et al. |
| 6,315,043 | B1 | | 11/2001 | Farrant et al. |
| 6,315,049 | B1 | | 11/2001 | Hickey et al. |
| 6,367,547 | B1 | | 4/2002 | Towers |
| 6,371,210 | B1 | | 4/2002 | Bode |
| 6,433,991 | B1 | | 8/2002 | Deaton et al. |
| 6,450,263 | B1 | | 9/2002 | Schwendemann |
| 6,464,011 | B2 | | 10/2002 | Tubel |
| 6,470,970 | B1 | | 10/2002 | Purkis |
| 6,547,010 | B2 | | 4/2003 | Hensley et al. |
| 6,567,013 | B1 | | 5/2003 | Purkis et al. |
| 6,575,237 | B2 | | 6/2003 | Purkis |
| 6,585,051 | B2 | | 7/2003 | Purkis |
| 6,622,794 | B2 | | 9/2003 | Zisk |
| 6,627,081 | B1 | | 9/2003 | Hilditch |
| 6,644,412 | B2 | | 11/2003 | Bode |
| 6,668,936 | B2 | | 12/2003 | Williamson, Jr. et al. |
| 6,679,332 | B2 | | 1/2004 | Vinegar et al. |
| 6,684,950 | B2 | | 2/2004 | Patel |
| 6,691,781 | B2 | | 2/2004 | Grant et al. |
| 6,719,048 | B1 | | 4/2004 | Ramos |
| 6,725,925 | B2 | | 4/2004 | Al-Ramadhn |
| 6,736,213 | B2 | | 5/2004 | Bussear |
| 6,782,952 | B2 | | 8/2004 | Garay |
| 6,796,213 | B1 | | 9/2004 | McKendree |
| 6,812,811 | B2 | | 11/2004 | Robison |
| 6,958,704 | B2 | | 10/2005 | Vinegar et al. |
| 6,967,589 | B1 | | 11/2005 | Peters |
| 7,007,756 | B2 | | 3/2006 | Lerche et al. |
| 7,011,152 | B2 | | 3/2006 | Soelvik |
| 7,017,662 | B2 | | 3/2006 | Schultz et al. |
| 7,038,332 | B2 | | 5/2006 | Robison |
| 7,040,391 | B2 | | 5/2006 | Leuthen et al. |
| 7,066,261 | B2 | | 6/2006 | Vicente et al. |
| 7,145,471 | B2 | | 12/2006 | Purkis et al. |
| 7,185,706 | B2 | | 3/2007 | Freyer |
| 7,210,534 | B2 | | 5/2007 | Hayter et al. |
| 7,290,606 | B2 | | 11/2007 | Coronado |
| 7,322,409 | B2 | | 1/2008 | Wittle et al. |
| 7,409,999 | B2 | | 8/2008 | Henriksen |
| 7,440,283 | B1 | | 10/2008 | Rafie |
| 7,468,890 | B2 | | 12/2008 | Lin |
| 7,520,321 | B2 | | 4/2009 | Hiron et al. |
| 7,537,056 | B2 | | 5/2009 | MacDougall |
| 8,091,637 | B2 | | 1/2012 | Fripp |
| 8,157,016 | B2 | | 4/2012 | James |
| 2001/0037884 | A1 | | 11/2001 | Schultz et al. |
| 2001/0042626 | A1 | | 11/2001 | Patel |
| 2002/0014338 | A1 | | 2/2002 | Purkis et al. |
| 2002/0066573 | A1 | | 6/2002 | Patel |
| 2003/0048197 | A1 | | 3/2003 | Purkis et al. |
| 2003/0131990 | A1 | | 7/2003 | Tubel et al. |
| 2003/0214366 | A1 | | 11/2003 | Robison |
| 2008/0041582 | A1 | | 2/2008 | Saetre |
| 2008/0041588 | A1 | | 2/2008 | Richards |
| 2008/0149323 | A1 | | 6/2008 | O'Malley et al. |
| 2008/0283238 | A1 | | 11/2008 | Richards |
| 2009/0078427 | A1 | | 3/2009 | Patel |
| 2009/0078428 | A1 | | 3/2009 | Ali |
| 2009/0101342 | A1 | | 4/2009 | Gaudette |
| 2009/0133869 | A1 | | 5/2009 | Clem |
| 2009/0151925 | A1 | | 6/2009 | Richards |
| 2009/0205834 | A1 | | 8/2009 | Garcia |
| 2010/0059233 | A1 | | 3/2010 | Smithson |
| 2010/0236790 | A1 | | 9/2010 | Smithson |
| 2010/0237698 | A1 | | 9/2010 | Smithson |
| 2011/0067854 | A1 | | 3/2011 | Love et al. |

FOREIGN PATENT DOCUMENTS

| | | | |
|---|---|---|---|
| WO | 2004081335 | A2 | 9/2004 |
| WO | WO2004081335 | A2 | 9/2004 |
| WO | 2007/116264 | A1 | 10/2007 |
| WO | 2010030266 | A1 | 3/2010 |
| WO | 2010030422 | A1 | 3/2010 |
| WO | 2010030423 | A1 | 3/2010 |
| WO | PCTUS08075668 | | 3/2010 |
| WO | PCTUS09046363 | | 3/2010 |
| WO | PCTUS09046404 | | 3/2010 |

OTHER PUBLICATIONS

International Search Report for PCT International Application No. PCT/US2012/025556 dated Feb. 15, 2013.

International Preliminary Report on Patentability issued Mar. 24, 2011, for International Patent Application No. PCT/US09/046363, 7 pages.

International Preliminary Report on Patentability issued Mar. 24, 2011, for International Patent Application No. PCT/US08/075668, 6 pages.

PCT Search Report issued Jan. 4, 2012 for PCT/US2011/021899, 2 pages.

International Search Report and Written Opinion issued Jul. 27, 2009, for International Application Serial No. PCT/US09/046363, 8 pages.

International Search Report and Written Opinion issued Jul. 27, 2009, for International Application Serial No. PCT/US09/046404, 8 pages.

International Search Report and Written Opinion issued Feb. 15, 2013, for International Patent Application Serial No. PCT/US2012/025556.

The Silicon-Controlled Rectifier (SCR), www.allaboutcircuits.com, vol. 3 Chapter 7, Oct. 24, 2010.

The Bidirectional Control Thyristor (BCT); Kenneth M. Thomas, Bjorn Backlund, Orhan Toker; Lenzburg, Switzerland.

(56) References Cited

OTHER PUBLICATIONS

Slider Technology Improves Directional Drilling Efficiency, National Energy Technology Laboratory; EPF Focus, Apr. 2007.
International Preliminary Report on Patentability, issued Mar. 24, 2011, for International Patent application No. PCT/US08/075668.
International Preliminary Report on Patentability, issued Mar. 24, 2011, for International Patent application No. PCT/US08/046363.
Office Action issued Oct. 5, 2011 for U.S. Appl. No. 12/555,541.
International Preliminary Report on Patentability, issued May 26, 2009, for International Patent application No. PCT/US08/075668.
Office Action issued Oct. 5, 2011 for U.S. Appl. No. 12/555,451, 23 pages.
International Search Report and Written Opinion issued May 26, 2009, for International Application Serial No. PCT/US08/075668, 11 pages.
International Search Report and Written Opinion issued Mar. 24, 2011, for PCT/US09/056339.
International Search Report and Written Opinion issued Oct. 21, 2009, for PCT/US09/056339.
International Search Report and Written Opinion issued Aug. 7, 2012, for PCT/US2012/021949.
Office Action issued Mar. 7, 2012 for U.S. Appl. No. 12/555,451.
International Search Report and Written Opinion issued May 7, 2007, for International Patent Application Serial No. PCT/US06/02304, 6 pages.
Lee Flosert Constant Flow Rate Product Brochure. Dec. 2002, 1 page.
Office Action issued Jun. 24, 2009 for U.S. Appl. No. 11/626,033, 23 pages.
International Search Report and Written Opinion issued Oct. 21, 2009, for International Patent Application Serial No. PCT/US09/56339, 8 pages.
Australian Office Action issued Feb. 4, 2010, for Australian Patent Application Serial No. 2006336428, 2 pages.
Canadian Office Action issued Nov. 18, 2009, for Canadian Patent Application Serial No. 2,637,326, 3 pages.
Office Action issued Dec. 17, 2009, for U.S. Appl. No. 11/626,033, 10 pages.
Advisory Action issued May 14, 2012, for U.S. Appl. No. 12/555,451, 3 pages.
Office Action issued May 21, 2012, for U.S. Appl. No. 12/792,402, 29 pages.
International Search Report and Written Opinion issued Jan. 4, 2012, for PCT Patent Application No. PCT/US2011/021899, 2 pages.
U.S. Appl. No. 12/390,758, filed Feb. 23, 2009, 31 pages.
Canadian Office Action dated Mar. 19, 2013, for Canadian Application No. 2,735,384.

* cited by examiner

SNEAK PATH ELIMINATOR FOR DIODE MULTIPLEXED CONTROL OF DOWNHOLE WELL TOOLS

CROSS-REFERENCE TO RELATED APPLICATIONS

This application is a Continuation-in-Part of U.S. application Ser. No. 12/792,298, filed Jun. 2, 2010, which is a Continuation-in-Part of International Application Serial No. PCT/US08/75668, filed Sep. 9, 2008, and claims the benefit of International Application Serial No. PCT/US09/46363, filed Jun. 5, 2009. The entire disclosures of these prior applications are incorporated herein by reference for all purposes.

BACKGROUND

The present disclosure relates generally to operations performed and equipment utilized in conjunction with a subterranean well and, in an embodiment described herein, more particularly provides for sneak path elimination in diode multiplexed control of downhole well tools.

It is useful to be able to selectively actuate well tools in a subterranean well. For example, production flow from each of multiple zones of a reservoir can be individually regulated by using a remotely controllable choke for each respective zone. The chokes can be interconnected in a production tubing string so that, by varying the setting of each choke, the proportion of production flow entering the tubing string from each zone can be maintained or adjusted as desired.

Unfortunately, this concept is more complex in actual practice. In order to be able to individually actuate multiple downhole well tools, a relatively large number of wires, lines, etc. have to be installed and/or complex wireless telemetry and downhole power systems need to be utilized. Each of these scenarios involves use of relatively unreliable downhole electronics and/or the extending and sealing of many lines through bulkheads, packers, hangers, wellheads, etc.

Therefore, it will be appreciated that advancements in the art of remotely actuating downhole well tools are needed. Such advancements would preferably reduce the number of lines, wires, etc. installed, would preferably reduce or eliminate the need for downhole electronics, and would preferably prevent undesirable current draw.

SUMMARY

In carrying out the principles of the present disclosure, systems and methods are provided which advance the art of downhole well tool control. One example is described below in which a relatively large number of well tools may be selectively actuated using a relatively small number of lines, wires, etc. Another example is described below in which a direction of current flow through a set of conductors is used to select which of two respective well tools is to be actuated. Yet another example is described below in which current flow is not permitted through unintended well tool control devices.

In one aspect, a system for selectively actuating from a remote location multiple downhole well tools in a well is provided. The system includes at least one control device for each of the well tools, such that a particular one of the well tools can be actuated when a respective control device is selected. Conductors are connected to the control devices, whereby each of the control devices can be selected by applying a predetermined voltage potential across a respective predetermined pair of the conductors. At least one lockout device is provided for each of the control devices, whereby the lockout devices prevent current from flowing through the respective control devices if the voltage potential across the respective predetermined pair of the conductors is less than a predetermined minimum.

In another aspect, a method of selectively actuating from a remote location multiple downhole well tools in a well is provided. The method includes the steps of: selecting a first one of the well tools for actuation by applying a predetermined minimum voltage potential to a first set of conductors in the well; and preventing actuation of a second one of the well tools when the predetermined minimum voltage potential is not applied across a second set of conductors in the well. At least one of the first set of conductors is the same as at least one of the second set of conductors.

In yet another aspect, a system for selectively actuating from a remote location multiple downhole well tools in a well includes at least one control device for each of the well tools, such that a particular one of the well tools can be actuated when a respective control device is selected; conductors connected to the control devices, whereby each of the control devices can be selected by applying a predetermined voltage potential across a respective predetermined pair of the conductors; and at least one lockout device for each of the control devices, whereby each lockout device prevents a respective control device from being selected if the voltage potential across the respective predetermined pair of the conductors is less than a predetermined minimum.

One of the conductors may be a tubular string extending into the earth, or in effect "ground."

These and other features, advantages, benefits and objects will become apparent to one of ordinary skill in the art upon careful consideration of the detailed description of representative embodiments of the disclosure herein below and the accompanying drawings, in which similar elements are indicated in the various figures using the same reference numbers.

DETAILED DESCRIPTION

It is to be understood that the various embodiments of the present disclosure described herein may be utilized in various orientations, such as inclined, inverted, horizontal, vertical, etc., and in various configurations, without departing from the principles of the present disclosure. The embodiments are described merely as examples of useful applications of the principles of the disclosure, which is not limited to any specific details of these embodiments.

In the following description of the representative embodiments of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Figure 1:
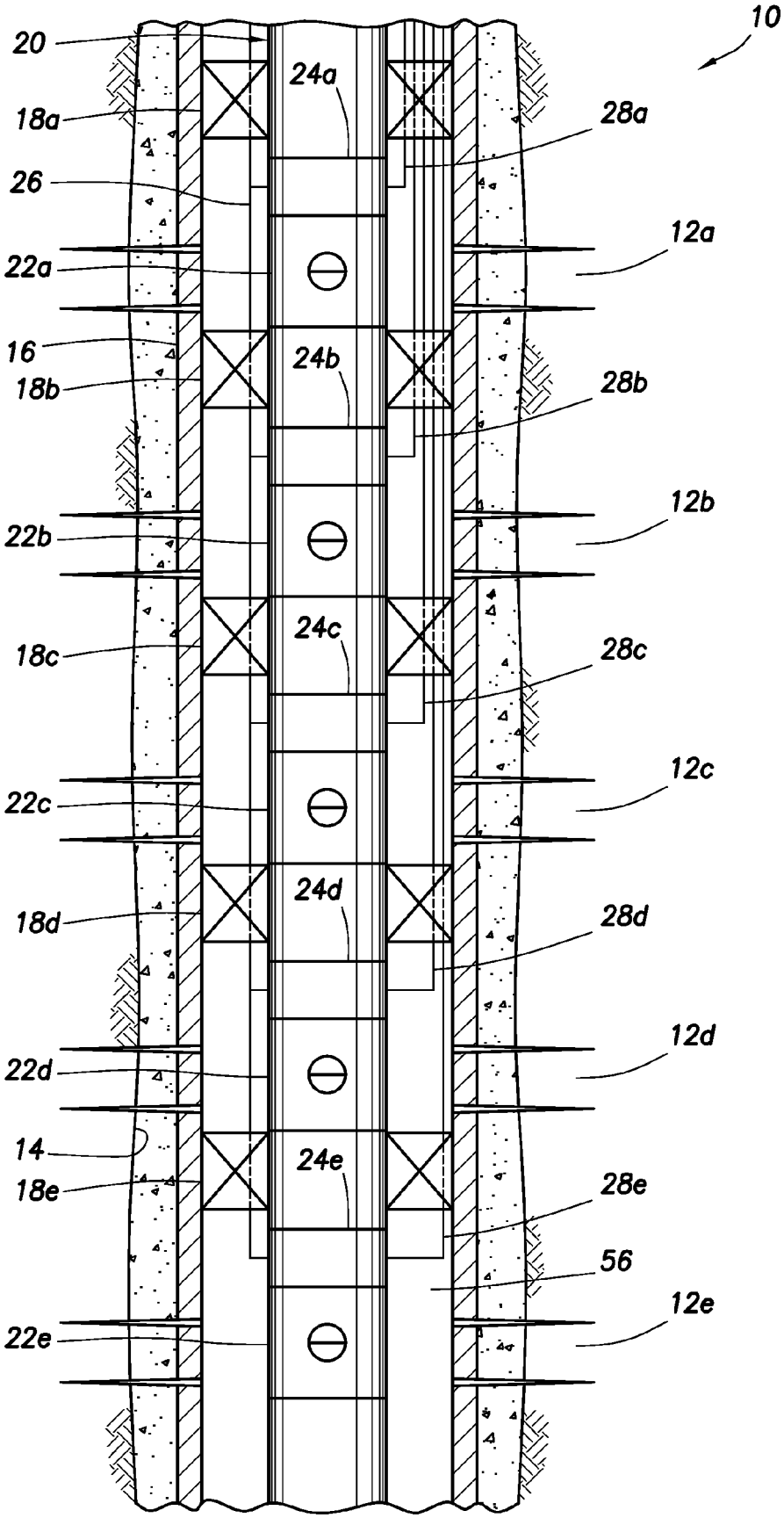
FIG. 1 (PRIOR ART)
FIG. 1 is a schematic view of a prior art well control system.

Representatively illustrated in FIG. 1 is a well control system 10 which is used to illustrate the types of problems inherent in prior art systems and methods. Although the drawing depicts prior art concepts, it is not meant to imply that any particular prior art well control system included the exact configuration illustrated in FIG. 1.

The control system 10 as depicted in FIG. 1 is used to control production flow from multiple zones 12*a-e* intersected by a wellbore 14. In this example, the wellbore 14 has been cased and cemented, and the zones 12*a-e* are isolated within a casing string 16 by packers 18*a-e* carried on a production tubing string 20.

Fluid communication between the zones 12*a-e* and the interior of the tubing string 20 is controlled by means of flow control devices 22*a-e* interconnected in the tubing string. The flow control devices 22*a-e* have respective actuators 24*a-e* for actuating the flow control devices open, closed or in a flow choking position between open and closed.

In this example, the control system 10 is hydraulically operated, and the actuators 24*a-e* are relatively simple piston-and-cylinder actuators. Each actuator 24*a-e* is connected to two hydraulic lines—a balance line 26 and a respective one of multiple control lines 28*a-e*. A pressure differential between the balance line 26 and the respective control line 28*a-e* is applied from a remote location (such as the earth's surface, a subsea wellhead, etc.) to displace the piston of the corresponding actuator 24*a-e* and thereby actuate the associated flow control device 22*a-e*, with the direction of displacement being dependent on the direction of the pressure differential.

There are many problems associated with the control system 10. One problem is that a relatively large number of lines 26, 28*a-e* are needed to control actuation of the devices 22*a-e*. These lines 26, 28*a-e* must extend through and be sealed off at the packers 18*a-e*, as well as at various bulkheads, hangers, wellhead, etc.

Another problem is that it is difficult to precisely control pressure differentials between lines extending perhaps a thousand or more meters into the earth. This can lead to improper or unwanted actuation of the devices 22*a-e*, as well as imprecise regulation of flow from the zones 12*a-e*.

Attempts have been made to solve these problems by using downhole electronic control modules for selectively actuating the devices 22*a-e*. However, these control modules include sensitive electronics which are frequently damaged by the hostile downhole environment (high temperature and pressure, etc.).

Furthermore, electrical power must be supplied to the electronics by specialized high temperature batteries, by downhole power generation or by wires which (like the lines 26, 28*a-e*) must extend through and be sealed at various places in the system. Signals to operate the control modules must be supplied via the wires or by wireless telemetry, which includes its own set of problems.

Thus, the use of downhole electronic control modules solves some problems of the control system 10, but introduces other problems. Likewise, mechanical and hydraulic solutions have been attempted, but most of these are complex, practically unworkable or failure-prone.

Figure 2:
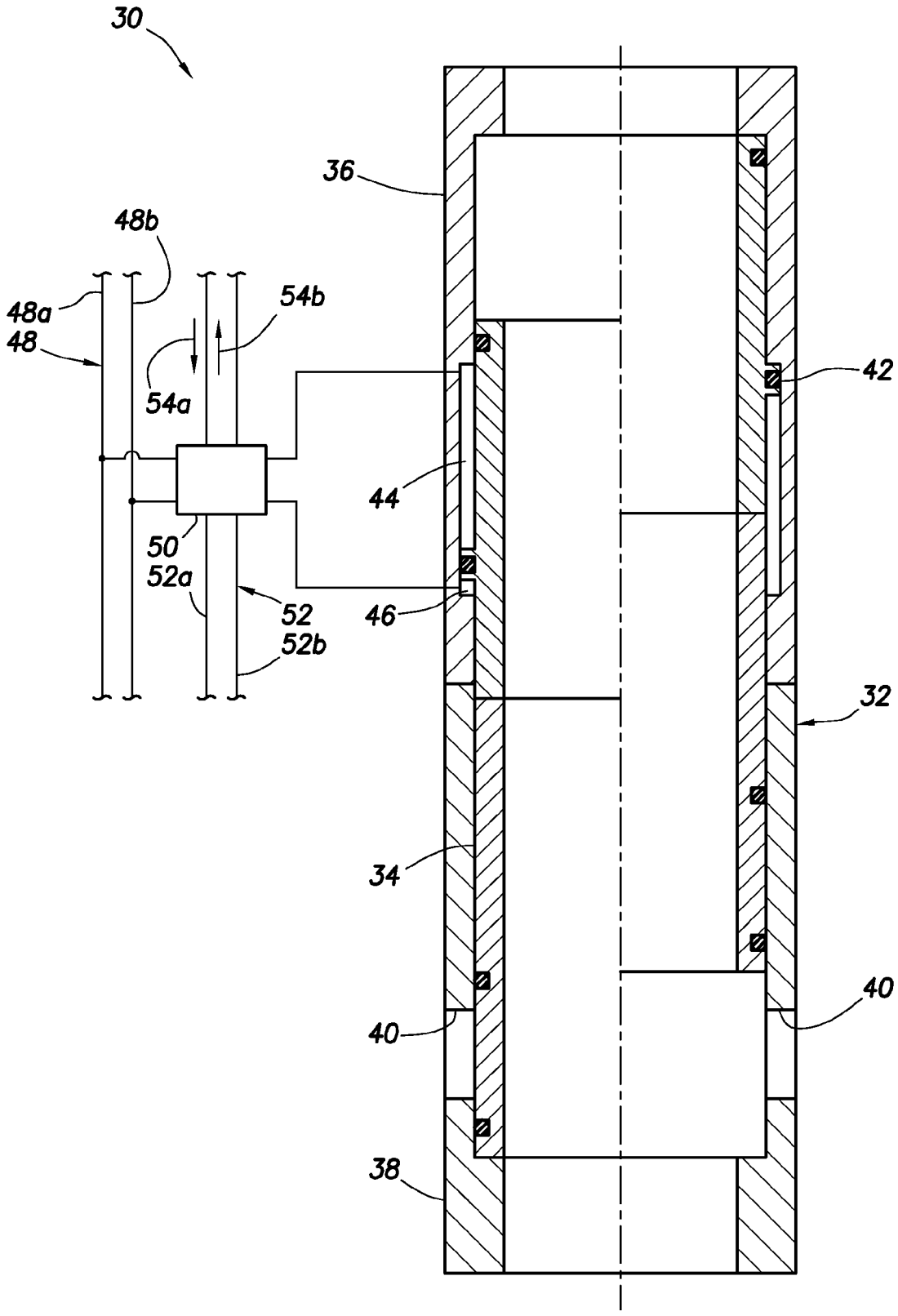
FIG. 2 is an enlarged scale schematic view of a flow control device and associated control device which embody principles of the present disclosure.

Turning now to FIG. 2, a system 30 and associated method for selectively actuating multiple well tools 32 are representatively illustrated. Only a single well tool 32 is depicted in FIG. 2 for clarity of illustration and description, but the manner in which the system 30 may be used to selectively actuate multiple well tools is described more fully below.

The well tool 32 in this example is depicted as including a flow control device 38 (such as a valve or choke), but other types or combinations of well tools may be selectively actuated using the principles of this disclosure, if desired. A sliding sleeve 34 is displaced upwardly or downwardly by an actuator 36 to open or close ports 40. The sleeve 34 can also be used to partially open the ports 40 and thereby variably restrict flow through the ports.

The actuator 36 includes an annular piston 42 which separates two chambers 44, 46. The chambers 44, 46 are connected to lines 48*a,b* via a control device 50. D.C. current flow in a set of electrical conductors 52*a,b* is used to select whether the well tool 32 is to be actuated in response to a pressure differential between the lines 48*a,b*.

In one example, the well tool 32 is selected for actuation by flowing current between the conductors 52*a,b* in a first direction 54*a* (in which case the chambers 44, 46 are connected to the lines 48*a,b*), but the well tool 32 is not selected for actuation when current flows between the conductors 52*a,b* in a second, opposite, direction 54*b* (in which case the chambers 44, 46 are isolated from the lines 48*a,b*). Various configurations of the control device 50 are described below for accomplishing this result. These control device 50 configurations are advantageous in that they do not require complex, sensitive or unreliable electronics or mechanisms, but are instead relatively simple, economical and reliable in operation.

The well tool 32 may be used in place of any or all of the flow control devices 22*a-e* and actuators 24*a-e* in the system 10 of FIG. 1. Suitably configured, the principles of this disclosure could also be used to control actuation of other well tools, such as selective setting of the packers 18*a-e*, etc.

Note that the hydraulic lines 48*a,b* are representative of one type of fluid pressure source 48 which may be used in keeping with the principles of this disclosure. It should be understood that other fluid pressure sources (such as pressure within the tubing string 20, pressure in an annulus 56 between the tubing and casing strings 20, 16, pressure in an atmospheric or otherwise pressurized chamber, etc., may be used as fluid pressure sources in conjunction with the control device 50 for supplying pressure to the actuator 36 in other embodiments.

The conductors 52*a,b* comprise a set of conductors 52 through which current flows, and this current flow is used by the control device 50 to determine whether the associated well tool 32 is selected for actuation. Two conductors 52*a,b* are depicted in FIG. 2 as being in the set of conductors 52, but it should be understood that any number of conductors may be used in keeping with the principles of this disclosure. In addition, the conductors 52*a,b* can be in a variety of forms, such as wires, metal structures (for example, the casing or tubing strings 16, 20, etc.), or other types of conductors.

The conductors 52*a,b* preferably extend to a remote location (such as the earth's surface, a subsea wellhead, another location in the well, etc.). For example, a surface power supply and multiplexing controller can be connected to the conductors 52*a,b* for flowing current in either direction 54*a,b* between the conductors.

In the examples described below, n conductors can be used to selectively control actuation of n*(n−1) well tools. The benefits of this arrangement quickly escalate as the number of well tools increases. For example, three conductors may be used to selectively actuate six well tools, and only one additional conductor is needed to selectively actuate twelve well tools.

Figure 3:
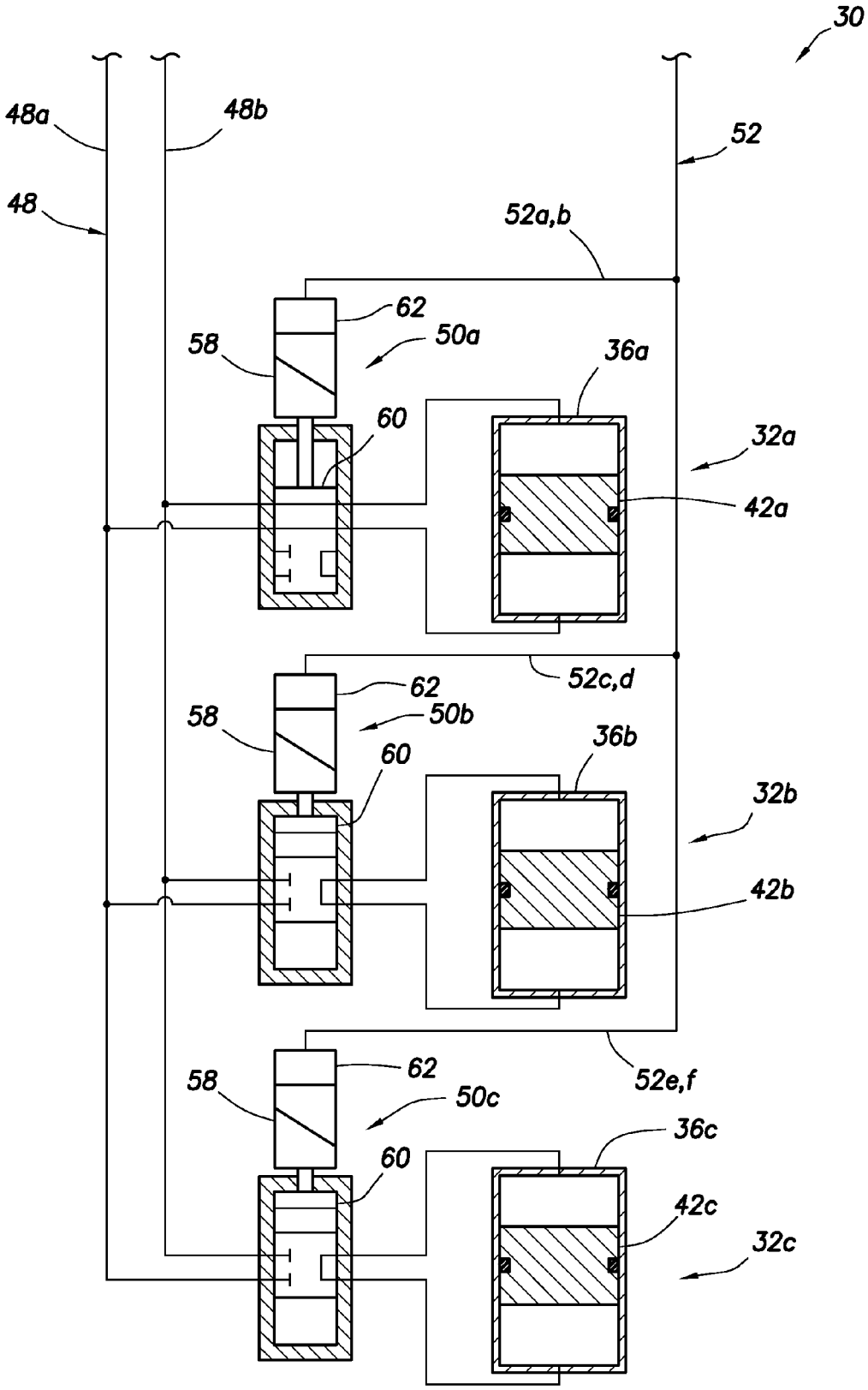
FIG. 3 is a schematic electrical and hydraulic diagram showing a system and method for remotely actuating multiple downhole well tools.

Referring additionally now to FIG. 3, a somewhat more detailed illustration of the electrical and hydraulic aspects of one example of the system 30 are provided. In addition, FIG. 3 provides for additional explanation of how multiple well tools 32 may be selectively actuated using the principles of this disclosure.

In this example, multiple control devices 50*a-c* are associated with respective multiple actuators 36*a-c* of multiple well tools 32*a-c*. It should be understood that any number of control devices, actuators and well tools may be used in keeping with the principles of this disclosure, and that these elements may be combined, if desired (for example, multiple control devices could be combined into a single device, a single well tool can include multiple functional well tools, an actuator and/or control device could be built into a well tool, etc.).

Each of the control devices 50*a-c* depicted in FIG. 3 includes a solenoid actuated spool or poppet valve. A solenoid 58 of the control device 50*a* has displaced a spool or poppet valve 60 to a position in which the actuator 36*a* is now connected to the lines 48*a,b*. A pressure differential between the lines 48*a,b* can now be used to displace the piston 42*a* and actuate the well tool 32*a*. The remaining control devices 50*b,c* prevent actuation of their associated well tools 32*b,c* by isolating the lines 48*a,b* from the actuators 36*b,c*.

The control device 50*a* responds to current flow through a certain set of the conductors 52. In this example, conductors 52*a,b* are connected to the control device 50*a*. When current flows in one direction through the conductors 52*a,b*, the control device 50*a* causes the actuator 36*a* to be operatively connected to the lines 48*a,b*, but when current flows in an opposite direction through the conductors, the control device causes the actuator to be operatively isolated from the lines.

As depicted in FIG. 3, the other control devices 50*b,c* are connected to different sets of the conductors 52. For example, control device 50*b* is connected to conductors 52*c,d* and control device 50*c* is connected to conductors 52*e,f*.

When current flows in one direction through the conductors 52*c,d*, the control device 50*b* causes the actuator 36*b* to be operatively connected to the lines 48*a,b*, but when current flows in an opposite direction through the conductors, the control device causes the actuator to be operatively isolated from the lines. Similarly, when current flows in one direction through the conductors 52*e,f*, the control device 50*c* causes the actuator 36*c* to be operatively connected to the lines 48*a,b*, but when current flows in an opposite direction through the conductors, the control device causes the actuator to be operatively isolated from the lines.

However, it should be understood that multiple control devices are preferably, but not necessarily, connected to each set of conductors. By connecting multiple control devices to the same set of conductors, the advantages of a reduced number of conductors can be obtained, as explained more fully below.

The function of selecting a particular well tool 32*a-c* for actuation in response to current flow in a particular direction between certain conductors is provided by directional elements 62 of the control devices 50*a-c*. Various different types of directional elements 62 are described more fully below.

Figure 4:
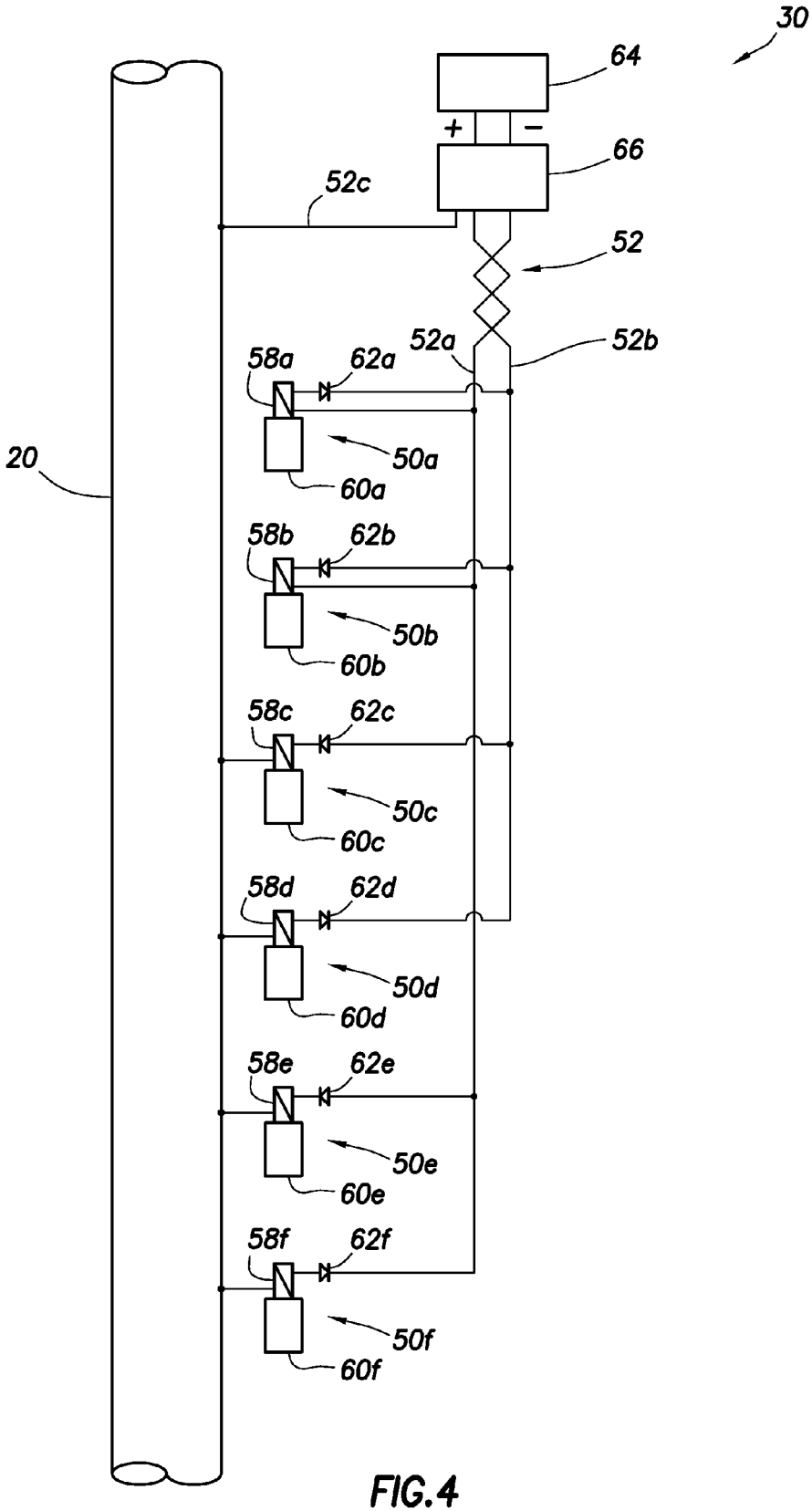
FIG. 4 is a schematic electrical diagram showing another configuration of the system and method for remotely actuating multiple downhole well tools.

Referring additionally now to FIG. 4, an example of the system 30 is representatively illustrated, in which multiple control devices are connected to each of multiple sets of conductors, thereby achieving the desired benefit of a reduced number of conductors in the well. In this example, actuation of six well tools may be selectively controlled using only three conductors, but, as described herein, any number of conductors and well tools may be used in keeping with the principles of this disclosure.

As depicted in FIG. 4, six control devices 50*a-f* are illustrated apart from their respective well tools. However, it will be appreciated that each of these control devices 50*a-f* would in practice be connected between the fluid pressure source 48 and a respective actuator 36 of a respective well tool 32 (for example, as described above and depicted in FIGS. 2 & 3).

The control devices 50*a-f* include respective solenoids 58*a-f*, spool valves 60*a-f* and directional elements 62*a-f*. In this example, the elements 62*a-f* are diodes. Although the solenoids 58*a-f* and diodes 62*a-f* are electrical components, they do not comprise complex or unreliable electronic circuitry, and suitable reliable high temperature solenoids and diodes are readily available.

A power supply 64 is used as a source of direct current. The power supply 64 could also be a source of alternating current and/or command and control signals, if desired. However, the system 30 as depicted in FIG. 4 relies on directional control of current in the conductors 52 in order to selectively actuate the well tools 32, so alternating current, signals, etc. should be present on the conductors only if such would not interfere with this selection function. If the casing string 16 and/or tubing string 20 is used as a conductor in the system 30, then preferably the power supply 64 comprises a floating power supply.

The conductors 52 may also be used for telemetry, for example, to transmit and receive data and commands between the surface and downhole well tools, actuators, sensors, etc. This telemetry can be conveniently transmitted on the same conductors 52 as the electrical power supplied by the power supply 64.

The conductors 52 in this example comprise three conductors 52*a-c*. The conductors 52 are also arranged as three sets of conductors 52*a,b* 52*b,c* and 52*a,c*. Each set of conductors includes two conductors. Note that a set of conductors can share one or more individual conductors with another set of conductors.

Each conductor set is connected to two control devices. Thus, conductor set 52*a,b* is connected to each of control devices 50*a,b*, conductor set 52*b,c* is connected to each of control devices 50*c,d*, and conductor set 52*a,c* is connected to each of control devices 50*e,f*.

In this example, the tubing string 20 is part of the conductor 52*c*. Alternatively, or in addition, the casing string 16 or any other conductor can be used in keeping with the principles of this disclosure.

It will be appreciated from a careful consideration of the system 30 as depicted in FIG. 4 (including an observation of how the diodes 62*a-f* are arranged between the solenoids 58*a-f* and the conductors 52*a-c*) that different current flow directions between different conductors in the different sets of conductors can be used to select which of the solenoids 58*a-f* are powered to thereby actuate a respective well tool. For example, current flow from conductor 52*a* to conductor 52*b* will provide electrical power to solenoid 58*a* via diode 62*a*, but oppositely directed current flow from conductor 52*b* to conductor 52*a* will provide electrical power to solenoid 58*b* via diode 62*b*. Conversely, diode 62*a* will prevent solenoid 58*a* from being powered due to current flow from conductor 52*b* to conductor 52*a*, and diode 62*b* will prevent solenoid 58*b* from being powered due to current flow from conductor 52*a* to conductor 52*b*.

Similarly, current flow from conductor 52*b* to conductor 52*c* will provide electrical power to solenoid 58*c* via diode 62*c*, but oppositely directed current flow from conductor 52*c* to conductor 52*b* will provide electrical power to solenoid 58*d* via diode 62*d*. Diode 62*c* will prevent solenoid 58*c* from being powered due to current flow from conductor 52*c* to conductor 52*b*, and diode 62*d* will prevent solenoid 58*d* from being powered due to current flow from conductor 52*b* to conductor 52*c*.

Current flow from conductor 52*a* to conductor 52*c* will provide electrical power to solenoid 58*e* via diode 62*e*, but oppositely directed current flow from conductor 52*c* to conductor 52*a* will provide electrical power to solenoid 58*f* via diode 62*f*. Diode 62*e* will prevent solenoid 58*e* from being powered due to current flow from conductor 52*c* to conductor 52*a*, and diode 62*f* will prevent solenoid 58*f* from being powered due to current flow from conductor 52*a* to conductor 52*c*.

The direction of current flow between the conductors 52 is controlled by means of a switching device 66. The switching device 66 is interconnected between the power supply 64 and the conductors 52, but the power supply and switching device could be combined, or could be part of an overall control system, if desired.

Figure 5:
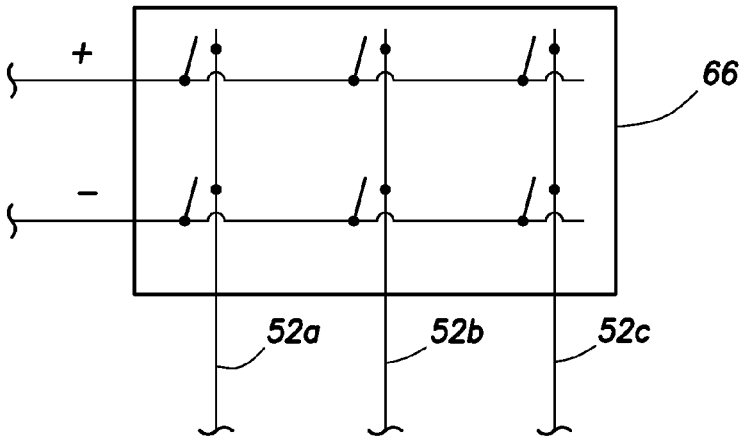
FIG. 5 is a schematic electrical diagram showing details of a switching arrangement which may be used in the system of FIG. 4.
Figure 6:
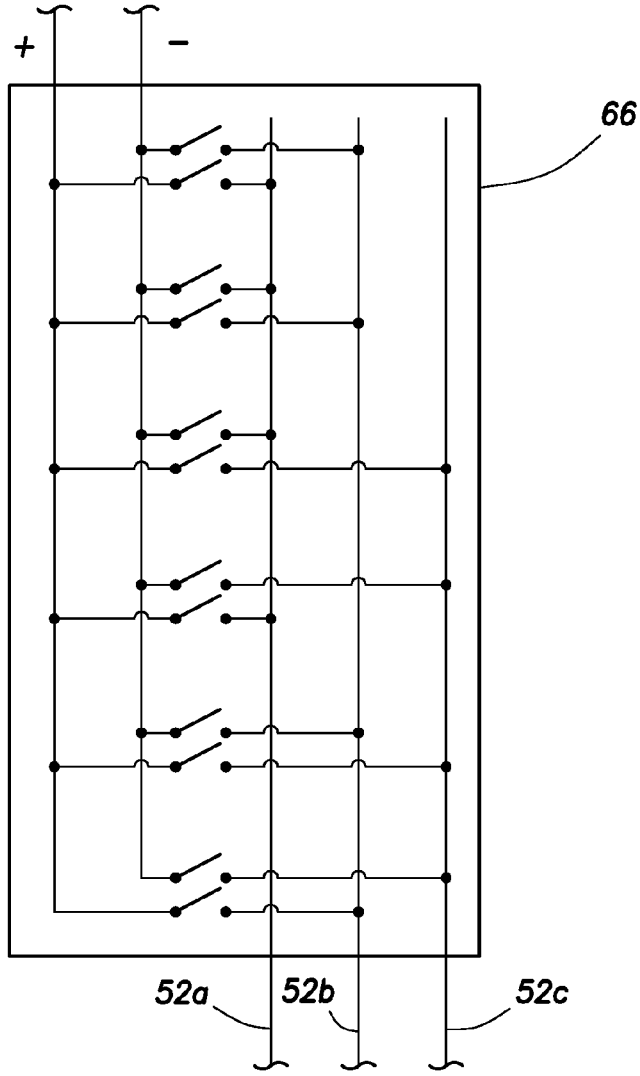
FIG. 6 is a schematic electrical diagram showing details of another switching arrangement which may be used in the system of FIG. 4.

Examples of different configurations of the switching device 66 are representatively illustrated in FIGS. 5 & 6. FIG. 5 depicts an embodiment in which six independently controlled switches are used to connect the conductors 52*a-c* to the two polarities of the power supply 64. FIG. 6 depicts an embodiment in which appropriate combinations of switches are closed to select a corresponding one of the well tools for actuation. This embodiment might be implemented, for example, using a rotary switch. Other implementations (such as using a programmable logic controller, etc.) may be utilized as desired.

Note that multiple well tools 32 may be selected for actuation at the same time. For example, multiple similarly configured control devices 50 could be wired in series or parallel to the same set of the conductors 52, or control devices connected to different sets of conductors could be operated at the same time by flowing current in appropriate directions through the sets of conductors.

In addition, note that fluid pressure to actuate the well tools 32 may be supplied by one of the lines 48, and another one of the lines (or another flow path, such as an interior of the tubing string 20 or the annulus 56) may be used to exhaust fluid from the actuators 36. An appropriately configured and connected spool valve can be used, so that the same one of the lines 48 is used to supply fluid pressure to displace the pistons 42 of the actuators 36 in each direction.

Preferably, in each of the above-described embodiments, the fluid pressure source 48 is pressurized prior to flowing current through the selected set of conductors 52 to actuate a well tool 32. In this manner, actuation of the well tool 32 immediately follows the initiation of current flow in the set of conductors 52.

Figure 7:
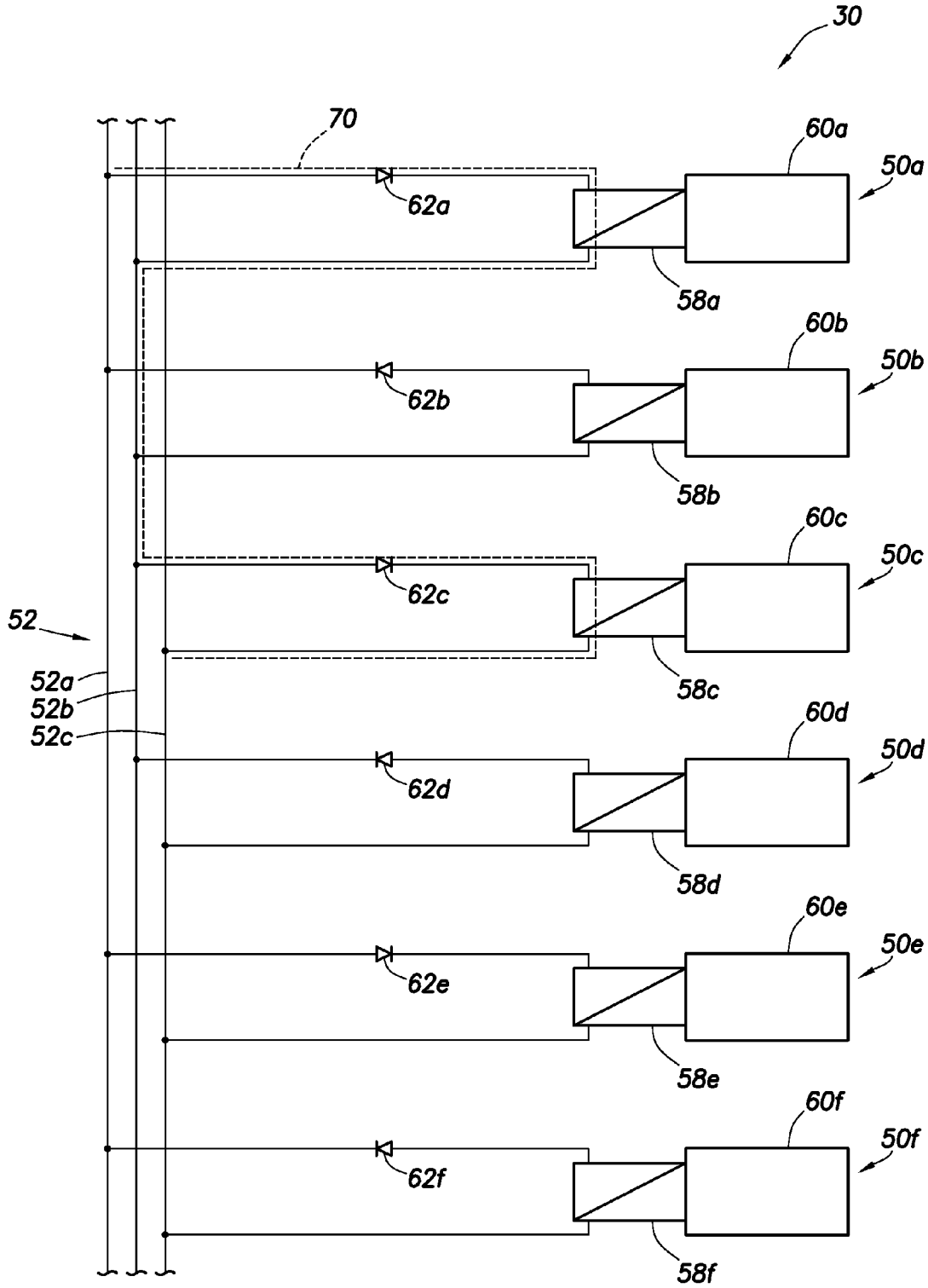
FIG. 7 is a schematic electrical diagram showing the configuration of FIG. 4, in which a current sneak path is indicated.
Figure 8:
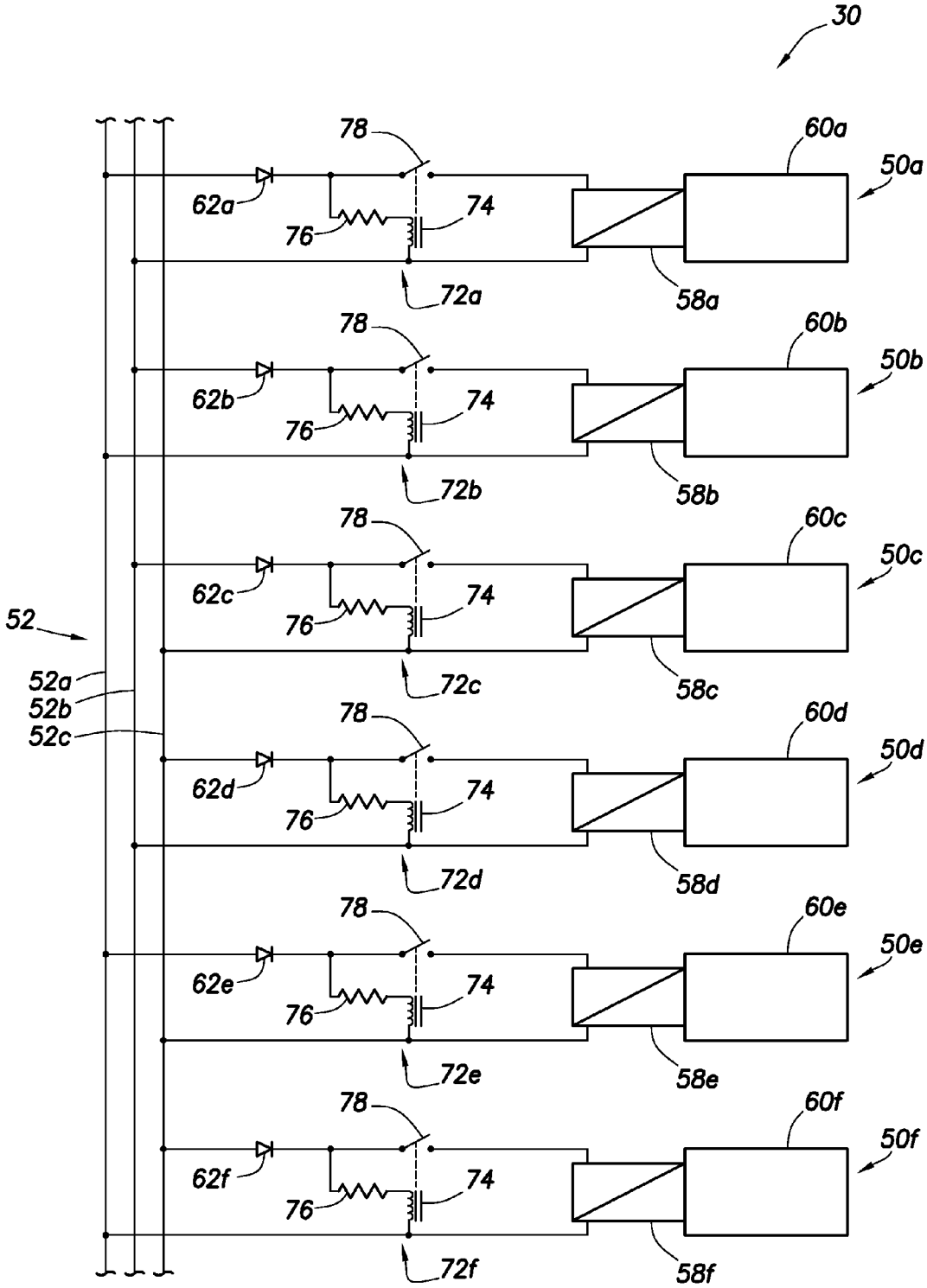
FIG. 8 is a schematic electrical diagram showing details of another configuration of the system and method, in which under-voltage lockout devices prevent current sneak paths in the system.

Referring additionally now to FIG. 7, the system 30 is depicted in a configuration similar in most respects to that of FIG. 4. In FIG. 7, however, a voltage potential is applied across the conductors 52*a*, 52*c* in order to select the control device 50*e* for actuation of its associated well tool 32. Thus, current flows from conductor 52*a*, through the directional element 62*e*, through the solenoid 58*e*, and then to the conductor 52*c*, thereby operating the shuttle valve 60*e*.

However, there is another path for current flow between the conductors 52*a,c*. This current "sneak" path 70 is indicated by a dashed line in FIG. 7. As will be appreciated by those skilled in the art, when a potential is applied across the conductors 52*a,c*, current can also flow through the control devices 50*a,c*, due to their common connection to the conductor 52*b*.

Since the potential in this case is applied across two solenoids 58*a,c* in the sneak path 70, current flow through the control devices 50*a,c* will be only half of the current flow through the control device 50*e* intended for selection, and so the system 30 is still operable to select the control device 50*e* without also selecting the unintended control devices 50*a,c*. However, additional current is flowed through the conductors 52*a,c* in order to compensate for the current lost to the control devices 50*a,c*, and so it is preferred that current not flow through any unintended control devices when an intended control device is selected.

This is accomplished in various examples described below by preventing current flow through each of the control devices 50*a-f* if a voltage potential applied across the control device is less than a minimum level. In each of the examples depicted in FIGS. 8-11 and described more fully below, under-voltage lockout devices 72*a-f* prevent current from flowing through the respective control devices 50*a-f*, unless the voltage applied across the control devices exceeds a minimum.

Figure 9:
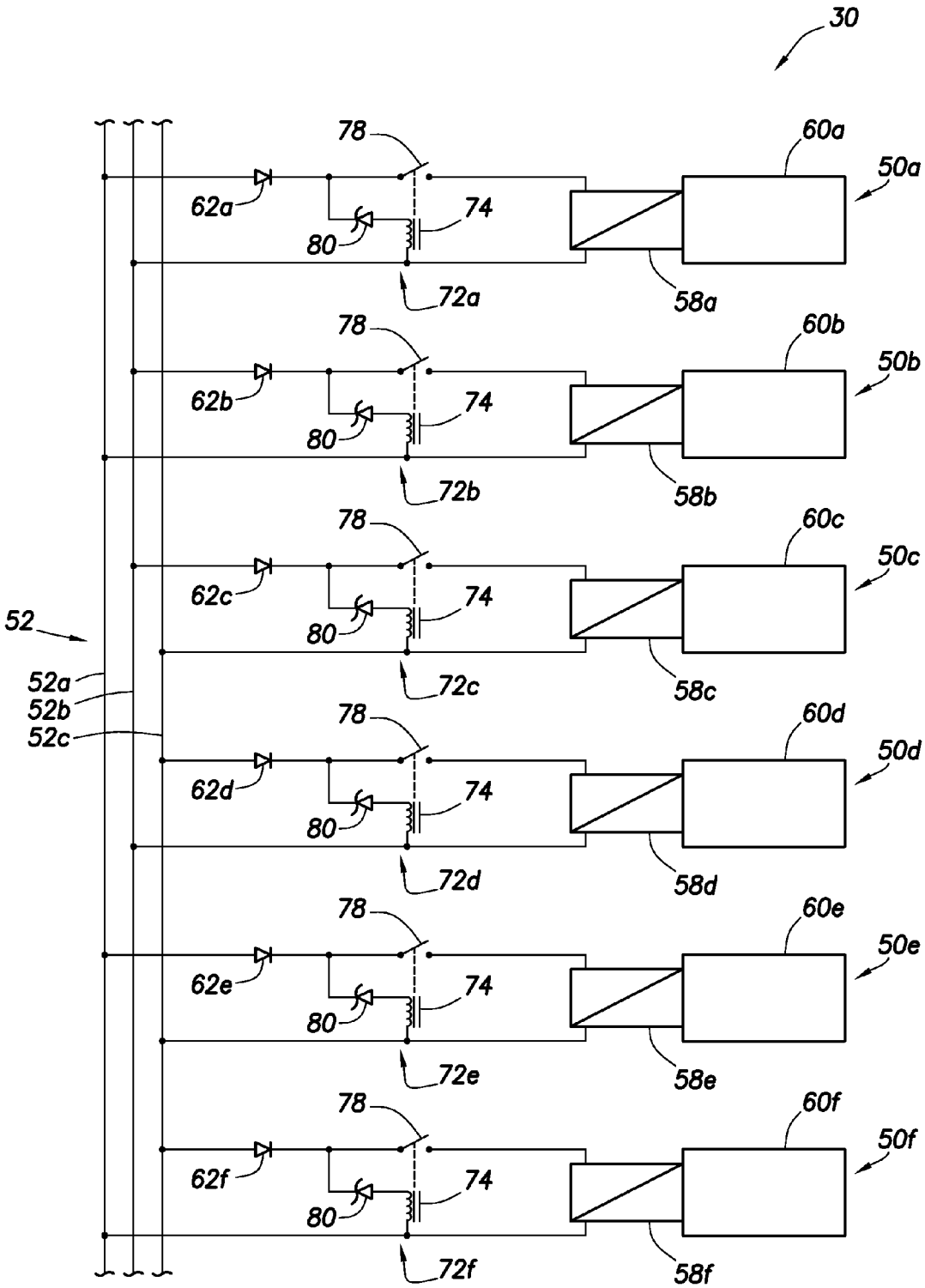
FIG. 9 is a schematic electrical diagram showing details of another configuration of the system and method, in which another configuration of under-voltage lockout devices prevent current sneak paths in the system.

In FIG. 9, each of the lockout devices 72*a-f* includes a relay 74 and a resistor 76. Each relay 74 includes a switch 78 interconnected between the respective control device 50*a-f* and the conductors 52*a-c*. The resistor 76 is used to set the minimum voltage across the respective conductors 52*a-c* which will cause sufficient current to flow through the associated relay 74 to close the switch 78.

If at least the minimum voltage does not exist across the two of the conductors 52*a-c* to which the control device 50*a-f* is connected, the switch 78 will not close. Thus, current will not flow through the associated solenoid 58*a-f*, and the respective one of the control devices 50*a-f* will not be selected.

As in the example of FIG. 7, sufficient voltage would not exist across the two conductors to which each of the lockout devices 72*a,c* is connected to operate the relays 74 therein if a voltage is applied across the conductors 52*a,c* in order to select the control device 50*e*. However, sufficient voltage would exist across the conductors 52*a,c* to cause the relay 74 of the lockout device 72*e* to close the switch 78 therein, thereby selecting the control device 50*e* for actuation of its associated well tool 32.

In FIG. 9, the lockout devices 72*a-f* each include the relay 74 and switch 78, but the resistor is replaced by a zener diode 80. Unless a sufficient voltage exists across each zener diode 80, current will not flow through its associated relay 74, and the switch 78 will not close. Thus, a minimum voltage must be applied across the two conductors 52*a-c* to which the respective one of the control devices 50*a-f* is connected, in order to close the associated switch 78 of the respective lockout device 72*a-f* and thereby select the control device.

Figure 10:
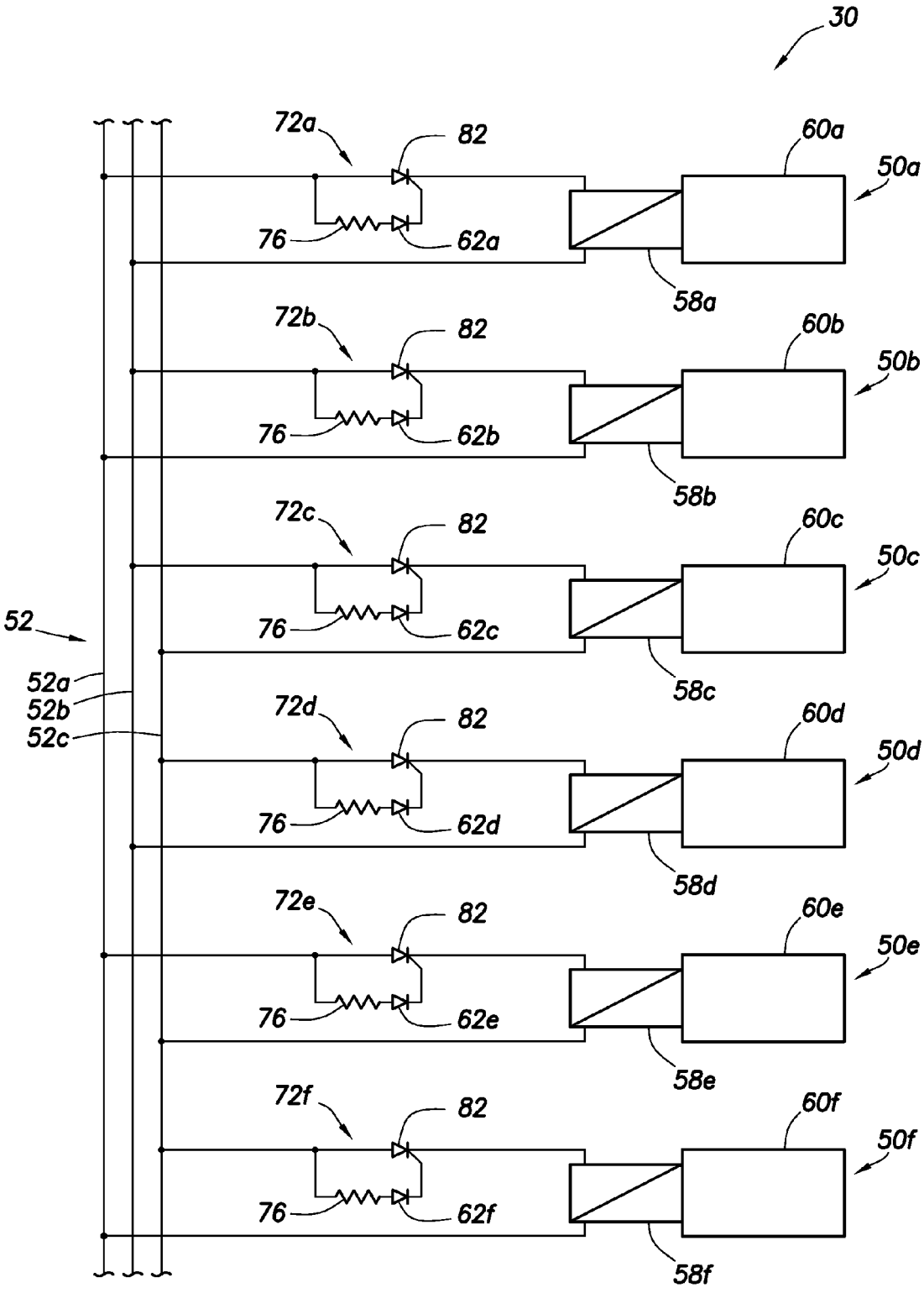
FIG. 10 is a schematic electrical diagram showing details of another configuration of the system and method, in which yet another configuration of under-voltage lockout devices prevent current sneak paths in the system.

In FIG. 10, a thyristor 82 (specifically in this example a silicon controlled rectifier) is used instead of the relay 74 in each of the lockout devices 72*a-f*. Other types of thyristors and other gating circuit devices (such as TRIAC, GTO, IGCT, SIT/SITh, DB-GTO, MCT, CSMT, RCT, BRT, etc.) may be used, if desired. Unless a sufficient voltage exists across the source and gate of the thyristor 82, current will not flow to its drain. Thus, a minimum voltage must be applied across the two of the conductors 52*a-c* to which the respective one of the control devices 50*a-f* is connected, in order to cause current flow through the thyristor 82 of the respective lockout device 72*a-f* and thereby select the control device. The thyristor 82 will continue to allow current flow from its source to its drain, as long as the current remains above a predetermined level.

Figure 11:
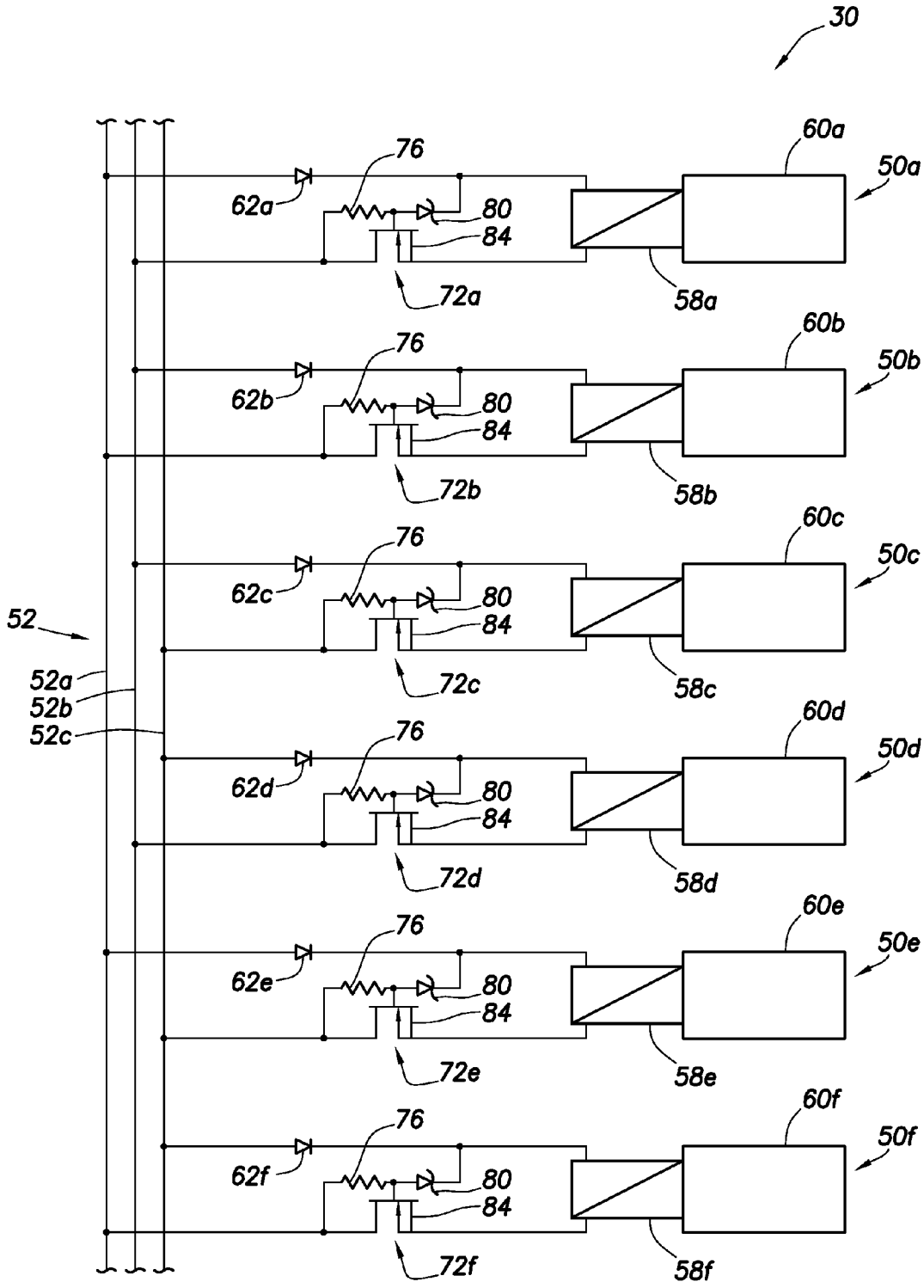
FIG. 11 is a schematic electrical diagram showing details of another configuration of the system and method, in which a further configuration of under-voltage lockout devices prevent current sneak paths in the system.

In FIG. 11, a field effect transistor 84 (specifically in this example an n-channel MOSFET) is interconnected between the control device 50*a-f* and one of the associated conductors 52*a-c* in each of the lockout devices 72*a-f*. Unless a voltage exists across the gate and drain of the transistor 84, current will not flow from its source to its drain. The voltage does not exist unless a sufficient voltage exists across the zener diode 80 to cause current flow through the diode. Thus, a minimum voltage must be applied across two of the conductors 52*a-c* to which the respective one of the control devices 50*a-f* is connected, in order to cause current flow through the transistor 84 of the respective lockout device 72*a-f* and thereby select the control device.

It may now be fully appreciated that the above disclosure provides several improvements to the art of selectively actuating downhole well tools. One such improvement is the elimination of unnecessary current draw by control devices which are not intended to be selected for actuation of their respective well tools.

The above disclosure provides a system 30 for selectively actuating from a remote location multiple downhole well tools 32 in a well. The system 30 includes at least one control device 50*a-f* for each of the well tools 32, such that a particular one of the well tools 32 can be actuated when a respective control device 50*a-f* is selected. Conductors 52 are connected to the control devices 50*a-f*, whereby each of the control devices 50*a-f* can be selected by applying a predetermined voltage potential across a respective predetermined pair of the conductors 52. At least one lockout device 72*a-f* is provided for each of the control devices 50*a-f*, whereby the lockout devices 72*a-f* prevent current from flowing through the respective control devices 50*a-f* if the voltage potential across the respective predetermined pair of the conductors 52 is less than a predetermined minimum.

Each of the lockout devices 72*a-f* may include a relay 74 with a switch 78. The relay 74 closes the switch 78, thereby permitting current flow through the respective control device 50*a-f* when the predetermined minimum voltage potential is applied across the lockout device 72*a-f*.

Each of the lockout devices 72*a-f* may include a thyristor 82. The thyristor 82 permits current flow from its source to is drain, thereby permitting current flow through the respective control device 50*a-f* when the predetermined minimum voltage potential is applied across the lockout device 72*a-f*.

Each of the lockout devices 72*a-f* may include a zener diode 80. Current flows through the zener diode 80, thereby permitting current flow through the respective control device 50*a-f* when the predetermined minimum voltage potential is applied across the lockout device 72*a-f*.

Each of the lockout devices 72*a-f* may include a transistor 84. The transistor 84 permits current flow from its source to is drain, thereby permitting current flow through the respective control device 50*a-f* when the predetermined minimum voltage potential is applied across the lockout device 72*a-f*.

Also described above is a method of selectively actuating from a remote location multiple downhole well tools 32 in a well. The method includes the steps of: selecting a first one of the well tools 32 for actuation by applying a predetermined minimum voltage potential to a first set of conductors 52*a,c* in the well; and preventing actuation of a second one of the well tools 32 when the predetermined minimum voltage potential is not applied across a second set of conductors in the well 52*a,b* or 52*b,c*. At least one of the first set of conductors 52*a,c* is the same as at least one of the second set of conductors 52*a,b* or 52*b,c*.

The selecting step may include permitting current flow through a control device 50*a-f* of the first well tool in response to the predetermined minimum voltage potential being applied across a lockout device 72*a-f* interconnected between the control device 50*a-f* and the first set of conductors 52*a,c*.

The current flow permitting step may include actuating a relay 74 of the lockout device 72*a-f* to thereby close a switch 78, thereby permitting current flow through the control device 50*a-f* when the predetermined minimum voltage potential is applied across the lockout device 72*a-f*.

The current flow permitting step may include permitting current flow from a source to a drain of a thyristor 82 of the lockout device 72*a-f*, thereby permitting current flow through the control device 50*a-f* when the predetermined minimum voltage potential is applied across the lockout device 72*a-f*.

The current flow permitting step may include permitting current flow through a zener diode 80 of the lockout device 72*a-f*, thereby permitting current flow through the control device 50*a-f* when the predetermined minimum voltage potential is applied across the lockout device 72*a-f*.

The current flow permitting step may include permitting current flow from a source to a drain of a transistor 84 of the lockout device 72*a-f*, thereby permitting current flow through the control device 50*a-f* when the predetermined minimum voltage potential is applied across the lockout device 72*a-f*.

The above disclosure also describes a system 30 for selectively actuating from a remote location multiple downhole well tools 32 in a well, in which the system 30 includes: at least one control device 50*a-f* for each of the well tools 32, such that a particular one of the well tools 32 can be actuated when a respective control device 50*a-f* is selected; conductors 52 connected to the control devices 50*a-f*, whereby each of the control devices 50*a-f* can be selected by applying a predetermined voltage potential across a respective predetermined pair of the conductors 52; and at least one lockout device 72*a-f* for each of the control devices 50*a-f*, whereby each lockout device 72*a-f* prevents a respective control device 50*a-f* from being selected if the voltage potential across the respective predetermined pair of the conductors 52 is less than a predetermined minimum.

Figure 12:
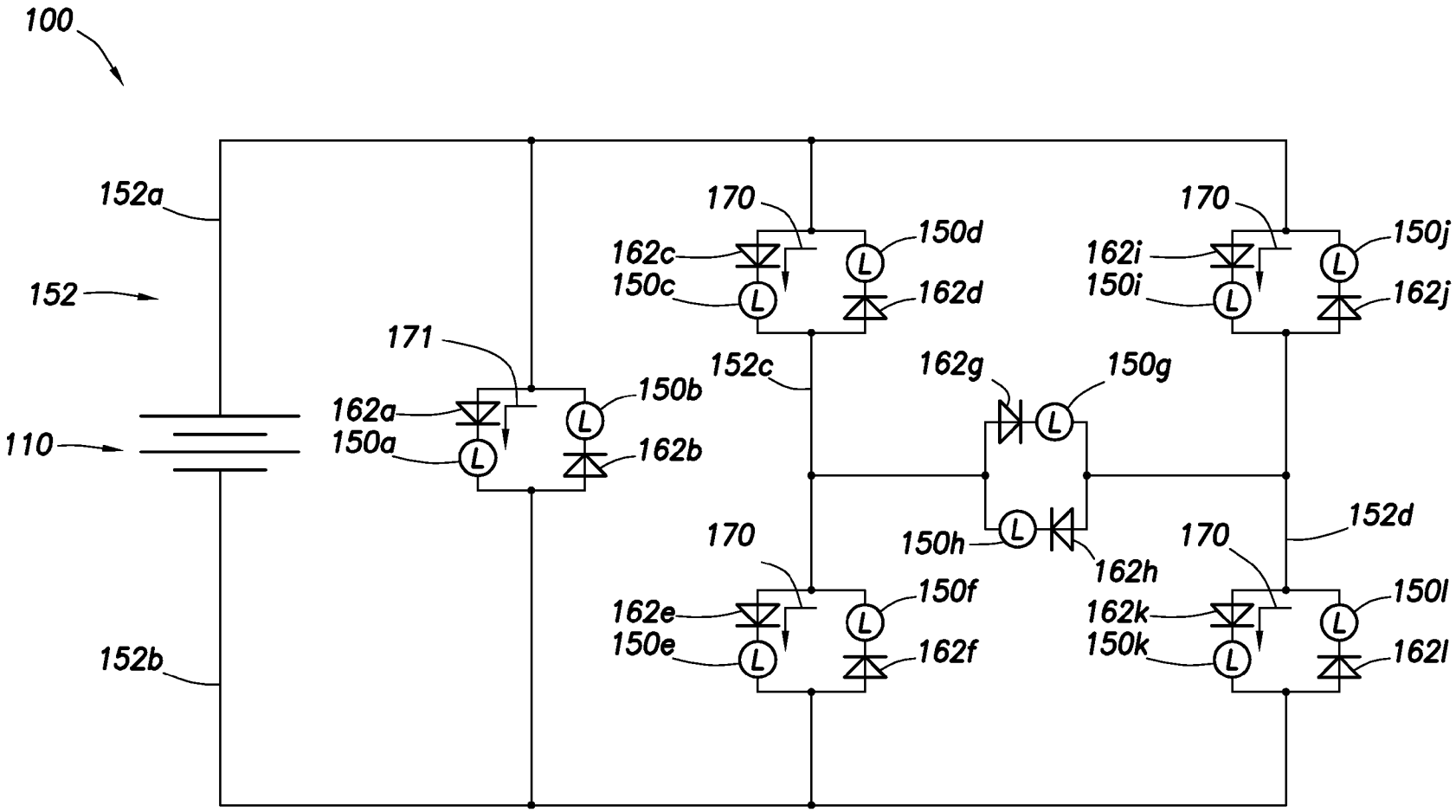
FIG. 12 is a schematic electrical diagram showing details of another configuration of the system and method, in which a further configuration of the lockout devices prevent current sneak paths in the system.

FIG. 12 is a schematic electrical diagram showing details of another configuration of the system and method, in which a further configuration of the lockout devices prevent current sneak paths in the system. In this example, the system 100 has a DC power supply 110. Alternative power supplies are explained above and will be apparent to one of skill in the art. The power supply could also be a source of AC and/or command and control signals, however, the system as depicted in FIG. 12 relies on directional control of current in order to selectively actuate the loads, so alternating current, signals, etc. should be present on the conductors only if such would not interfere with this selection function.

The system utilizes a set of conductors 152 comprising, in this example, four conductors 152*a-d*. For example, a three-wire TEC can be utilized, where the three wires act as conductors 152*a-c* and the sheath acts as the conductor 152*d*. It should be understood that any number of conductors may be used in keeping with the principles of this disclosure. In addition, the conductors 152*a-d* can be in a variety of forms, such as wires, metal structures (for example, the casing or tubing strings 16, 20, etc.), or other types of conductors.

The exemplary diagram utilizes twelve loads (L), 150*a-l*, are shown, each of which is actuated by a unique application of voltage potential across a pair of conductors and direct current in a selected direction. The twelve loads are generically represented (L) and can be any device requiring an electrical load to operate. For example, load devices can include control devices, actuators for well tools, solenoids and the like, as explained above, or motors, pumps, etc. Each load 150*a-l* has an associated directional element 162*a-l*, such as a diode, to isolate the loads depending on the direction of current applied.

As can be seen by inspection, a current flow from the power supply 110 along conductor 152*a* to 152*b* will flow along path 171 through directional element 162*a* and provide electrical power to load 150*a*. Thus, application of a voltage potential across conductors 152*a* and 152*b*, with current supplied in the direction from 152*a* to 152*b*, selects load 150*a* for operation. However, there are other paths for current flow between the conductors 152*a-b*. These current "sneak" or "leak" paths are indicated by arrows 170 in FIG. 12. The voltage potential is applied across four loads, 150*c, e, i* and *k*, in the sneak paths 170. Only half of the power goes through the desired path from 152*a* to 152*b*, while a quarter of the power goes through 152*a* to 152*c* to 152*b*, and a quarter from 152*a* to 152*d* to 152*b*. Half the power is wasted where the loads require the full voltage drop to be actuated, such as with solenoids, etc. This reduces the available power to the selected load. The leak path current can also create problems where the load which operates on partial power, such as a pump or motor, or where each load requires different power levels to operate. It is preferred that current not flow through any unintended load devices when an intended load device is selected. Problems are also encountered in alternate systems when differing resistances are encountered in the conductors.

Figure 13:
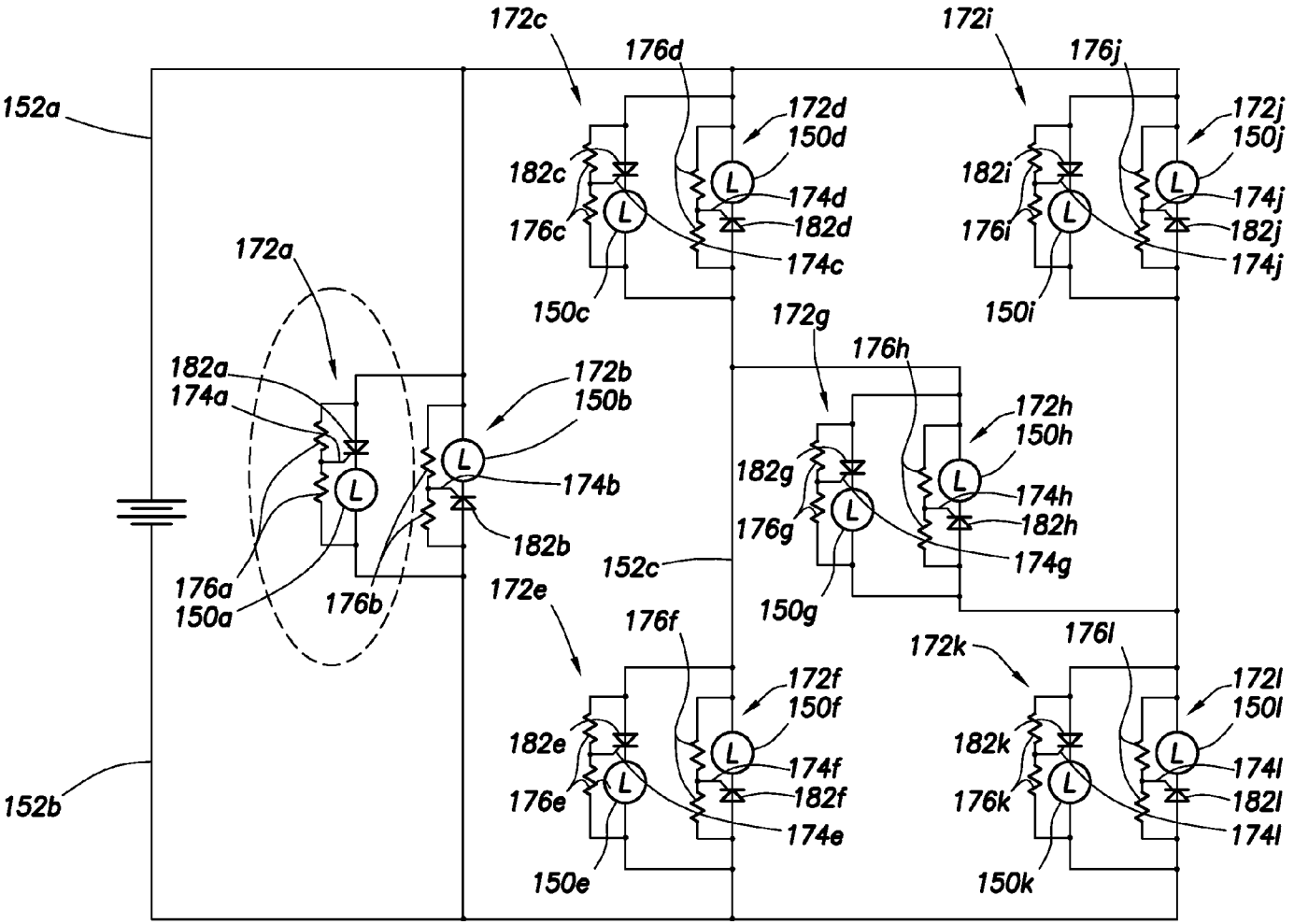
FIG. 13 is a schematic electrical diagram showing details of another configuration of the system and method, in which a further configuration of the lockout devices prevents current sneak paths in the system.

This is accomplished through the use of lock-out devices as described above. FIG. 13 is a schematic electrical diagram showing details of another configuration of the system and method, in which a further configuration of the lockout devices prevents current sneak paths in the system. In FIG. 13, each of the lockout devices 172*a-l* includes a silicon controlled rectifier (SCR) 182*a-l*, a type of thyristor, to control current flow through the load device based on a gate voltage. Essentially, the SCR blocks current until the voltage to the gate reaches a known critical level. At that point, current is allowed to flow from a selected conductor to another selected conductor in a selected direction. Furthermore, current will continue to flow regardless of the gate voltage until the current is dropped to zero or below a holding current value.

Each lockout device 172 includes resistors 176*a-l* and gate 174*a-l*. The resistors 176 are used to set the minimum voltage across the respective conductors 152*a-d* which will cause sufficient current to flow through the associated gate 174 to close the SCR 172. Then current is allowed to flow through the SCR and the load device. When power is initially applied, current will flow through each resistor in the network, along the selected path and leak paths. However, twice as much current will go through the resistors 176*a* in the desired path than through the resistors 176*c, e, i* and *k*, along the leak paths 170. Once the current is sufficient to create sufficient voltage at the gate 174*a*, the SCR 172*a* will "turn on." Once activated, the SCR will act as a short and allow full power to go through load device 150*a*. At this point, the system voltage will drop to that required by the load device and very little current will be routed through the resistors 176*a*.

The arrangement described increases the available power since little power is lost to the leak paths. Further, the system allows loads that operate at partial power since only the selected load device receives power. The system reduces problems with varying resistance in the conductors. Finally, the system allows for multiple types and loads downhole.

Figure 14:
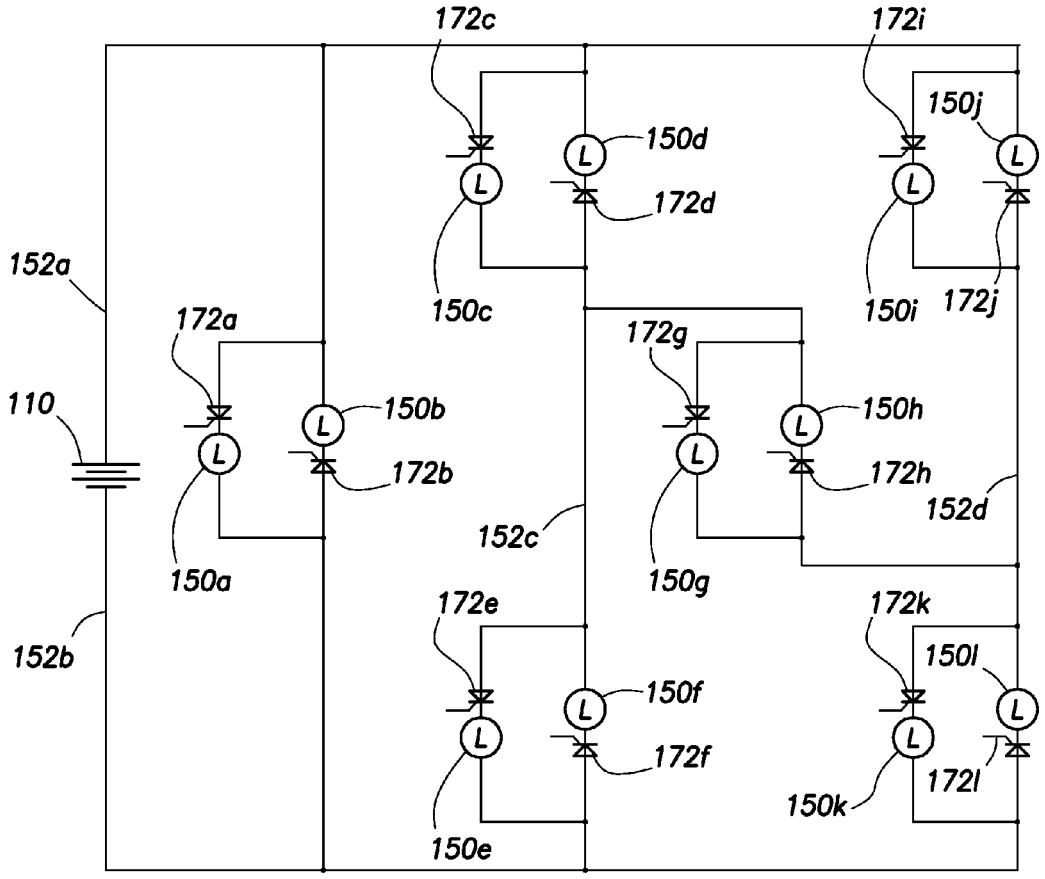
FIG. 14 is a schematic electrical diagram showing details of another configuration of the system and method utilizing SCRs.

FIG. 14 is a schematic electrical diagram showing details of another configuration of the system and method utilizing SCRs. SCRs can also be used without a specific gate voltage by exceeding their breakdown voltage in the forward biased direction. After the breakdown voltage is exceeded, the SCR acts as if the gate voltage had been applied. SCRs 172*a-l* are seen on an electrical diagram otherwise similar to that of FIG. 13. The SCR can be "re-set" by elimination or reduction of the current through the system.

Figure 15:
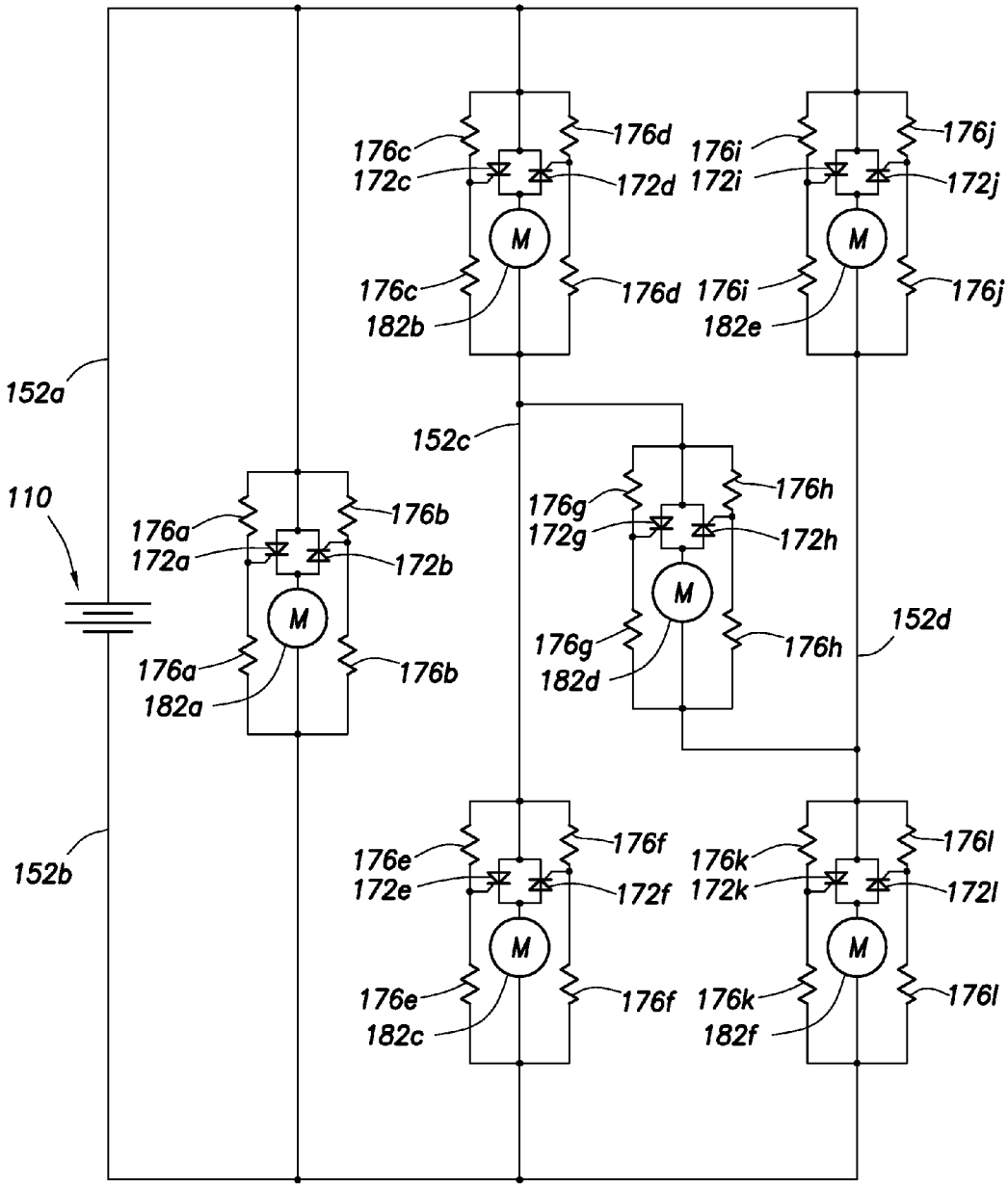
FIG. 15 is a schematic electrical diagram showing details of another configuration of the system and method for controlling bidirectional load devices, such as motors.

FIG. 15 is a schematic electrical diagram showing details of another configuration of the system and method for controlling bidirectional load devices, such as motors. FIG. 15 shows an electrical diagram similar to that of FIG. 14, having a system 100 with conductors 152*a-d* and power supply 110. Here the four conductors are utilized to selectively operate six bidirectional load devices 182*a-f*, such as bidirectional DC motors, M. It is understood that other bidirectional load devices can be substituted or similarly used, such as pumps, motion controllers, etc. In this system, the direction of current across a conductor pair correlates to the direction of the bidirectional device, forward or backward. For use with bidirectional load devices, SCRs 172*a-l* are used in parallel in pairs for each bidirectional load device 182*a-f* (SCRs 172*a-b* for load device 182*a*; SCRs 172*c-d* for load device 182*b*, etc.). This allows each bidirectional load device to be run forward or backward using the same set of conductors. Resistors 176*a-l* are employed as discussed above with respect to FIG. 13.

As before, the SCRs can be used without the resistors by simply exceeding the breakdown voltage of the SCRs.

Figure 16:
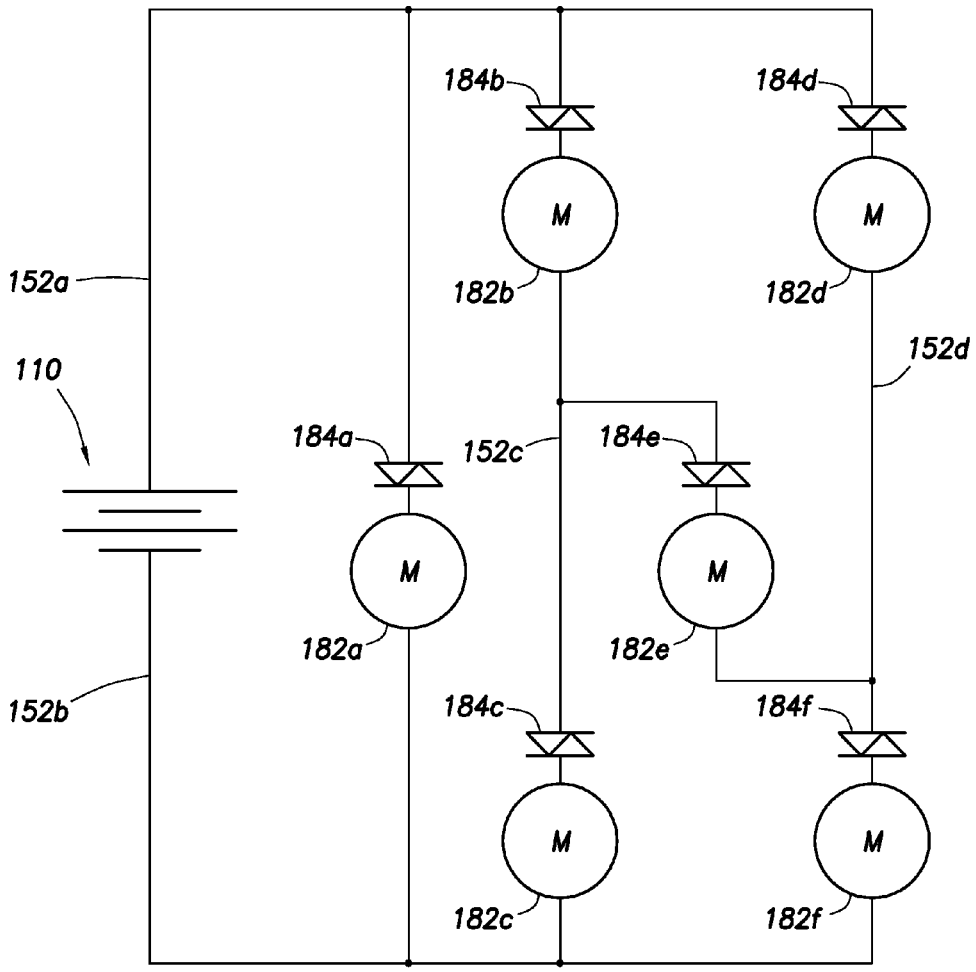
FIG. 16 is a schematic electrical diagram showing details of another configuration of the system and method utilizing alternate lock-out devices.

FIG. 16 is a schematic electrical diagram showing details of another configuration of the system and method utilizing alternate lock-out devices. In FIGS. 13-15 above, SCRs are a preferred type of thyristor or gated lockout device. Other types of thyristors and/or other gating circuit devices (such as TRIAC, GTO, IGCT, SIT/SITh, DB-GTO, MCT, CSMT, RCT, BRT, DIAC, diactor, SIDAC, etc.) may be used. FIG. 16 shows a diagram for operating multiple downhole bidirectional load devices 182*a-f*, such as motors, M. A DIAC 184*a-f* is arranged in series with a corresponding bidirectional load device 182*a-f*, as shown. SIDACs can be used in place of the DIAC devices. The DIAC is bidirectional, allowing it to be used with bidirectional load devices. The DIAC allows current flow only after its breakdown voltage has been reached. After the breakdown voltage is reached, current continues to flow through the DIAC until the current is reduced to zero or below a holding current value. The diagram is similar to that seen in FIG. 15 and will not be described in great detail here.

Although in the preferred embodiments described herein a single type of lockout device is utilized in any single embodiment, it is understood that multiple types of lockout devices can be utilized in a single system.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of the present disclosure. Accordingly, the foregoing detailed description is to be clearly understood as being given by way of illustration and example only, the spirit and scope of the present invention being limited solely by the appended claims and their equivalents.

It is claimed:

1. A system for selectively actuating from a remote location multiple downhole well tools in a well, the system comprising:

at least one load device associated with each of the well tools, such that a particular one of the well tools can be actuated when the corresponding load device is actuated;

conductors connected to the load devices, whereby each of the load devices can be actuated by applying a predetermined voltage potential across a respective predetermined pair of the conductors; and a lockout device for each of the load devices, whereby each lockout device prevents current from flowing through the corresponding load device if the voltage potential across the respective predetermined pair of the conductors is less than a predetermined minimum; and wherein each of the lockout devices includes an silicon controlled rectifier (SCR), a pair of resistors and a gate, and wherein the SCR is actuated only where the voltage applied across the lockout device exceeds a predetermined minimum gate voltage.

2. The system of claim 1, wherein the predetermined voltage minimum is the breakdown voltage of the SCR.

3. The system of claim 1, wherein the load devices are bidirectional load devices, and wherein the lockout devices are selected from the group consisting of: DIACs, SIDACs, TRIACs, and SCRs.

4. The system of claim 3, wherein each bidirectional load device has a corresponding pair of lockout devices arranged in parallel.

5. A method of selectively actuating from a remote location multiple downhole load devices in a well, the method comprising the steps of:

selecting a first one of the load devices for actuation by applying a predetermined minimum voltage potential to a first set of conductors in the well; and preventing leakage along at least one current leak path, at least one of the leak paths through at least one other conductor and at least one other load device, by positioning a lockout device along the leak path, the lockout device preventing current from flowing through the corresponding load device if the voltage potential across the lockout device is less than a predetermined minimum;

wherein the selecting step further comprises permitting current flow through the first load device in response to applying the predetermined minimum voltage potential across a lockout device interconnected between the first load device and the first set of conductors; and wherein the step of current flow permitting further comprises applying a voltage greater than the breakdown voltage of the lockout device.

6. A system for selectively actuating from a remote location multiple downhole bidirectional load devices in a well, the system comprising:

a direct current power supply;

a plurality of bidirectional load devices positioned in a well;

a plurality of conductors connected to the power supply and the bidirectional load devices, whereby each of the bidirectional load devices can be actuated by applying a voltage potential across a respective predetermined pair of the conductors, and whereby each of the bidirectional load devices can be run forward or backward depending on the direction of current through the pair of conductors; and at least one lockout device connected to each bidirectional load device, whereby the lockout device prevents current from flowing through the corresponding bidirectional load device until the voltage potential across the lockout device exceeds a predetermined minimum;

wherein the at least one lockout device connected to each bidirectional load device further comprises: a pair of lockout devices, arranged in parallel, and each connected to the corresponding bidirectional load device, wherein each lockout device prevents current flow in a selected direction, and wherein each lockout device prevents current flow therethrough until the voltage potential across the lockout device exceeds a predetermined minimum.

7. A system as in claim 6, wherein the lockout devices are selected from the group consisting of: thyristors, SCRs, DIACs, SIDACs, and TRIACs.

8. A system as in claim 6, wherein the bidirectional load devices are selected from the group consisting of: motors and pumps.

9. A system as in claim 6, wherein the at least one lockout device comprises:

a bidirectional lockout device, connected to the corresponding bidirectional load device, wherein the bidirectional lockout device prevents current flow in either direction, and wherein each lockout device prevents current flow therethrough until a voltage potential across the lockout device exceeds a predetermined minimum.

10. A system as in claim 9, wherein the bidirectional lockout device is selected from the group consisting of: DIACs, diactors, and TRIACs.

* * * * *